US008118625B2

(12) United States Patent
Tsai

(10) Patent No.: US 8,118,625 B2
(45) Date of Patent: Feb. 21, 2012

(54) ELECTRICAL CONNECTOR AND TERMINAL STRUCTURE THEREOF

(76) Inventor: Chou Hsien Tsai, SinJhuang (TW)

( * ) Notice: Subject to any disclaimer, the term of this patent is extended or adjusted under 35 U.S.C. 154(b) by 53 days.

(21) Appl. No.: 12/684,422

(22) Filed: Jan. 8, 2010

(65) Prior Publication Data

US 2010/0178809 A1 Jul. 15, 2010

(30) Foreign Application Priority Data

| | | |
|---|---|---|
| Mar. 6, 2009 | (TW) | 98203454 U |
| Mar. 25, 2009 | (TW) | 98204726 U |
| Jun. 1, 2009 | (TW) | 98209604 U |
| Jun. 4, 2009 | (TW) | 98209856 U |
| Sep. 10, 2009 | (TW) | 98216756 U |

(51) Int. Cl.
*H01R 13/02* (2006.01)

(52) U.S. Cl. ..... 439/885

(58) Field of Classification Search ..... 439/885; 29/884

See application file for complete search history.

(56) References Cited

U.S. PATENT DOCUMENTS

| | | | | |
|---|---|---|---|---|
| 7,621,788 | B1 * | 11/2009 | Feng | 439/885 |
| 7,927,159 | B2 * | 4/2011 | Zhang et al. | 439/885 |

* cited by examiner

*Primary Examiner* — Ross Gushi

(74) *Attorney, Agent, or Firm* — Pro-Techtor Int'l Services

(57) ABSTRACT

An electrical connector includes a row of terminals and a plastic base having a row of terminal slots. The terminals are disposed in the slots. Each terminal has an elastically moveable portion having a connection point, a fixing portion fixed into the slot, and a pin portion extending out of the plastic base. An inserted electrical element may be connected to the connection point and elastically move the elastically moveable portion. The row of terminals is one of two rows of terminals formed by oppositely tearing and pressing a metal sheet. The terminals have oppositely torn and cut portions seamlessly oppositely connected together. When the row of terminals is developed into a plane and one of the terminals is reverse-backside joined between the two neighboring terminals, the oppositely torn and cut portion of the terminal is seamlessly jointed to the oppositely torn and cut portions of the two neighboring terminals.

44 Claims, 30 Drawing Sheets

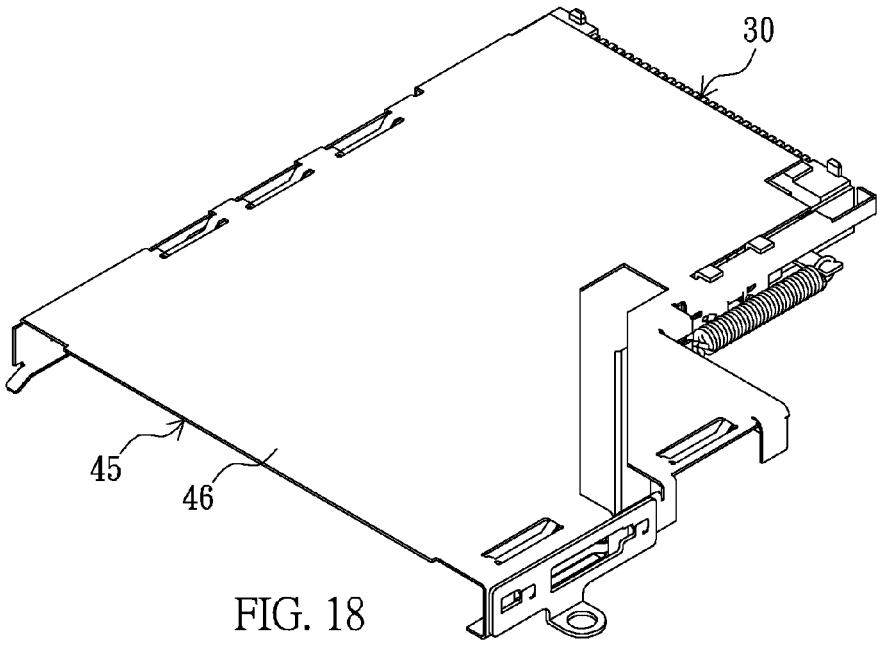
FIG. 18
FIG. 19
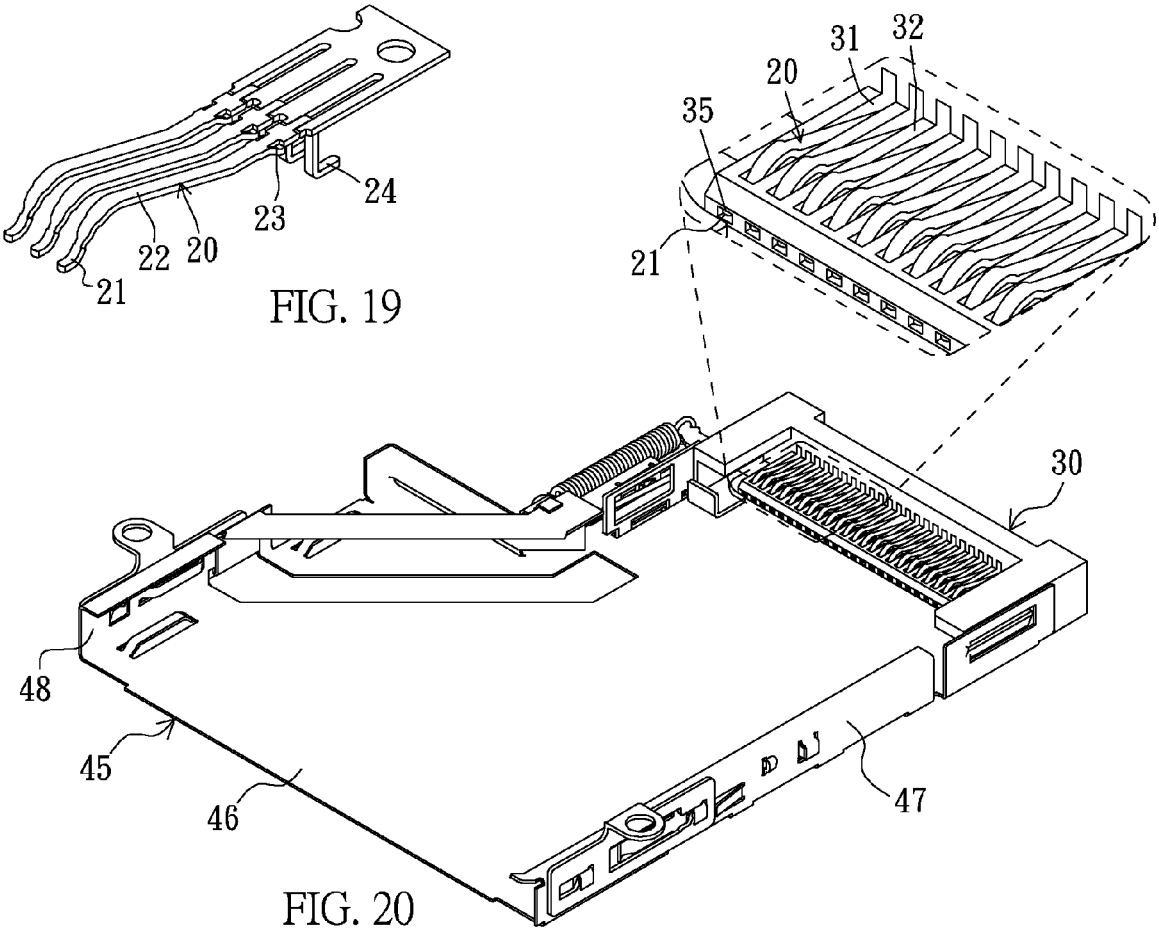
FIG. 20

ELECTRICAL CONNECTOR AND TERMINAL STRUCTURE THEREOF

BACKGROUND OF THE INVENTION

1. Field of the Invention

The invention relates to an electrical connector, and more particularly to an electrical connector having terminals manufactured by way of pressing so that the material is saved.

2. Related Art

Terminals of an electrical connector are manufactured by pressing a metal sheet. The terminals after being pressed are separately arranged and connected to a material tape according to a terminal gap of the electrical connector. Thus, the whole row of terminals may be assembled into the plastic base of the electrical connector at a time.

In the pressing process of manufacturing the whole row of continuously arranged terminals, the gap region between two neighboring terminals is formed by removing a portion of the material of the metal sheet, which is referred to as a waste product. Thus, it is necessary to reduce the waste product in order to reduce the cost of pressing the terminals.

SUMMARY OF THE INVENTION

It is therefore an object of the invention to provide an electrical connector and a terminal structure thereof, wherein two rows of terminals are oppositely torn and pressed to save the material.

Another object of the invention is to provide an electrical connector having terminals, wherein two rows of terminals are oppositely torn and pressed to save the material.

The invention achieves the above-identified objects by providing an electrical connector including a plastic base and at least one row of terminals. The plastic base has at least one row of terminal slots. The at least one row of terminals is disposed in the at least one row of terminal slots of the plastic base. Each of the terminals has an elastically moveable portion, a fixing portion and a pin portion from one end to the other end. The elastically moveable portion has a connection point. The fixing portion is fixed into the terminal slot. The pin portion extends out of the plastic base, and an inserted electrical element may be connected to the connection point and elastically move the elastically moveable portion. The at least one row of terminals is one row of two rows of terminals formed by oppositely tearing and pressing a metal sheet. Each of the terminals of the two rows of terminals has an oppositely torn and cut portion. The oppositely torn and cut portions are seamlessly oppositely connected together. When the one row of terminals is developed into a plane and one of the terminals is reverse-backside joined between the two neighboring terminals, the oppositely torn and cut portion of the terminal is seamlessly jointed to the oppositely torn and cut portions of the two neighboring terminals.

According to the above-mentioned structure, the two rows of terminals may be oppositely torn and pressed to save the material.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

FIG. 1 is a pictorially exploded view showing a first embodiment of the

FIG. 18 is a pictorial front view showing a sixth embodiment of the invention.

FIG. 19 is a pictorial view showing one row of terminals according to the sixth embodiment of the invention.

FIG. 20 is a pictorial view showing a backside of the sixth embodiment of the invention.

DETAILED DESCRIPTION OF THE INVENTION

Figure 1:
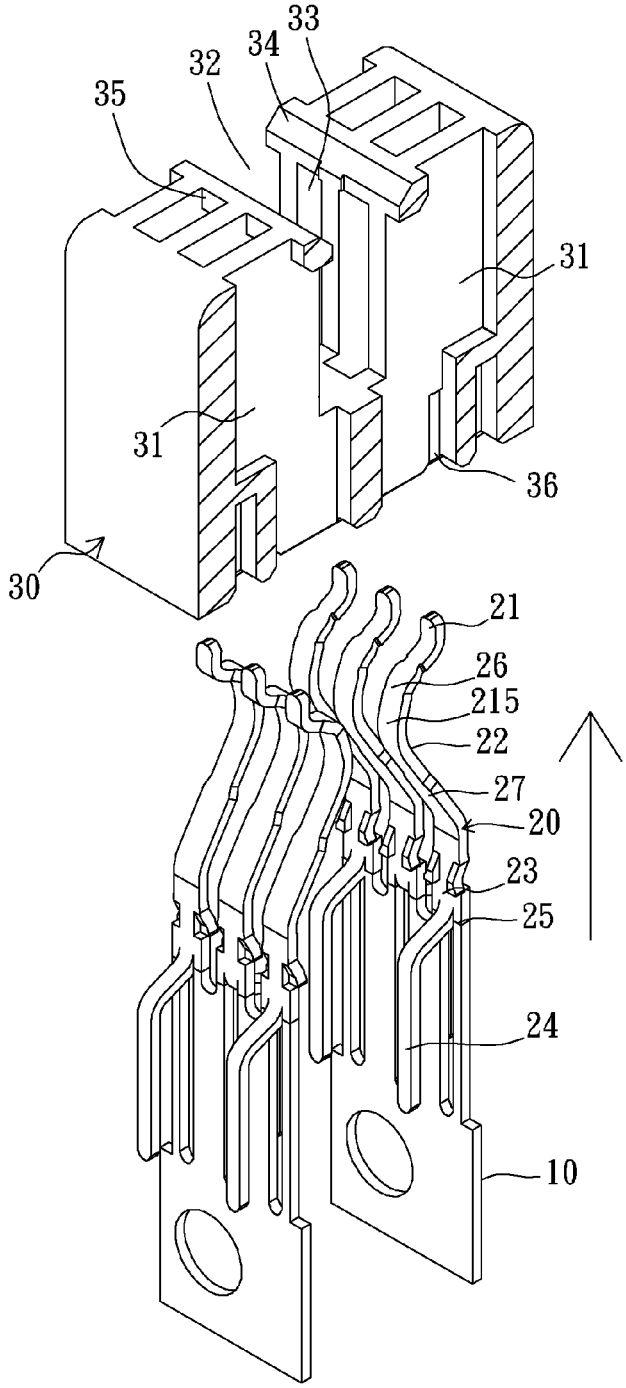
Figure 2:
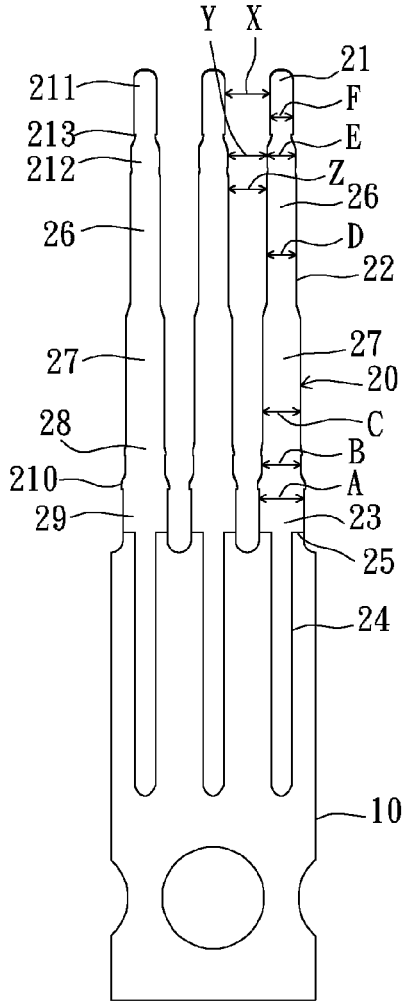
FIG. 2 is a developed plane view showing one row of terminals according to the first embodiment of the invention.
Figure 4:
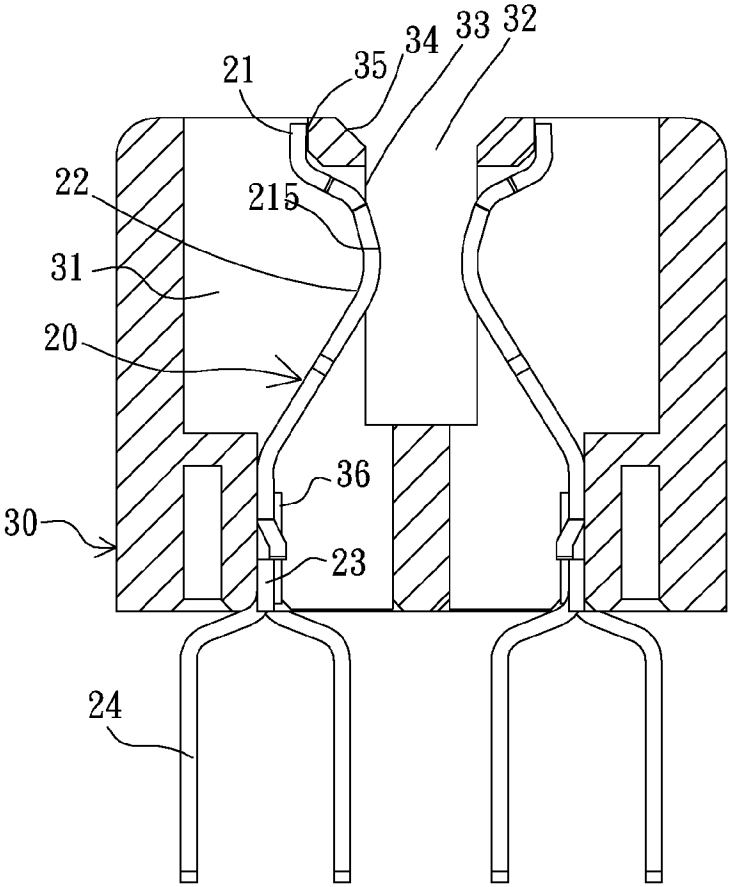
FIG. 4 is an assembled cross-sectional view showing the first embodiment of the invention.
Figure 3:
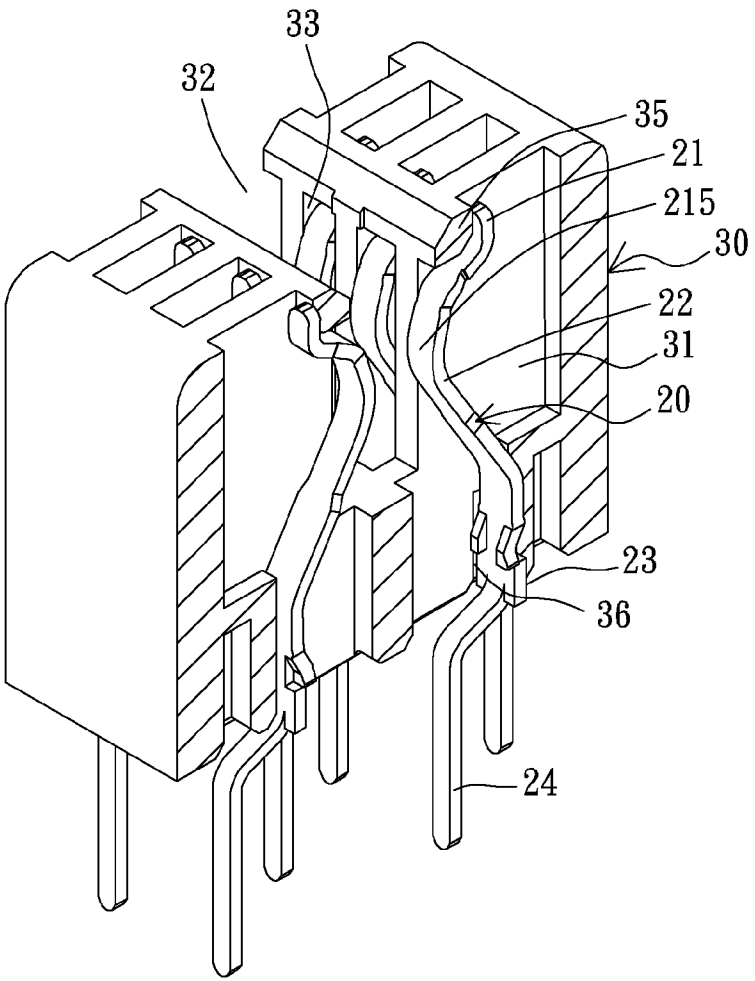
FIG. 3 is a pictorially assembled view showing the first embodiment of the invention.

The present invention will be apparent from the following detailed description, which proceeds with reference to the accompanying drawings, wherein the same references relate to the same elements.

Referring to FIGS. 1 to 4, the embodiment includes a plastic base 30 and two rows of terminals 20.

The plastic base 30 is longitudinal and has two rows of separately arranged terminal slots 31. A longitudinal connection slot 32 is formed between the two rows of terminal slots 31. The terminal slot 31 has an opening 33 communicating with the connection slot 32. The opening of the connection slot 32 faces upward and the top end of the opening is formed with a guide-in slant surface 34. The terminal slot 31 has a resting surface 35 disposed on a top end of the opening 33, and a lower segment of the terminal slot 31 is formed with an engaging slot 36.

The two rows of terminals 20 are disposed in the two rows of terminal slots 31 of the plastic base 30. Each row of the terminals 20 is connected to a material tape 10 and is one of the two rows of terminals formed by oppositely tearing and pressing a metal sheet. The two rows of terminals have the same structure. The one row of terminals 20 is assembled into the one row of terminal slots 31 and then the material tape 10 is broken for separation. The terminal 20 has an elastically moveable portion 21, an extension 22, a fixing portion 23 and a pin portion 24 from one end to the other end. The elastically moveable portion 21 has first and second ends. The extension 22 has first and second ends. The fixing portion 23 has first and second ends. The first end of the elastically moveable portion 21 is a tail end of the terminal. The second end of the elastically moveable portion is connected to the first end of the extension 22. The second end of the extension 22 is connected to the first end of the fixing portion 23. The second end of the fixing portion 23 is connected to the pin portion 24 and the material tape 10, and a cut mark 25 that may be easily broken is disposed between the fixing portion 23 and the pin portion 24. The width of the fixing portion 23 is greater than the width of the extension 22 so that the fixing portion 23 is engaged with the engaging slot 36 of the terminal slot 31. The fixing portion 23 has a first fixing portion segment 28 and a second fixing portion segment 29, which have different widths, from the first end to the second end. The width A of the second fixing portion segment is greater than the width B of the first fixing portion segment and a barb 210 with the greater width is formed between the first fixing portion segment and the second fixing portion segment. The width of the extension 22 is greater than the width of the elastically moveable portion 21. The extension 22 is a bent elastic arm and has a first extension segment 26 and a second extension segment 27, which have the same length, from the first end to the second end. The width C of the second extension segment is greater than the width D of the first extension segment. The first extension segment 26 has a projecting connection point 215. The connection point 215 extends from the opening 33 to the connection slot 32. The tail end of the elastically moveable portion 21 elastically rests against the resting surface 35. The elastically moveable portion 21 has a first elastically moveable portion segment 211 and a second elastically moveable portion segment 212, which have different widths, from the first end to the second end. The width E of the second elastically moveable portion segment is greater than the width F of the first elastically moveable portion segment, and a concave portion 213 with a smaller width is disposed between the first and second elastically moveable portion segments. The pin portion 24 extends out of the lower end of the plastic base 30.

The features of this embodiment reside in that each row of terminals is one of the two rows of terminals formed by oppositely tearing and pressing a metal sheet. Each terminal of the two rows of terminals has an oppositely torn and cut portion, and the oppositely torn and cut portions are seamlessly oppositely connected together. When the one row of terminals is developed into a plane and one terminal is reverse-backside joined between two neighboring terminals, the oppositely torn and cut portion of the terminal is seamlessly jointed to the oppositely torn and cut portions of the two neighboring terminals. The oppositely torn and cut portion of this embodiment includes the elastically moveable portion 21, the extension 22 and the fixing portion 23. The gaps between the elastically moveable portions 21 of the two neighboring terminals sequentially from the first ends to the second ends of the elastically moveable portions 21 are equal to the widths of the fixing portion 23 sequentially from the first end to the second end of the fixing portion 23, and the gaps between the extensions of the two neighboring terminals sequentially from the first ends to the second ends of the extensions are equal to the widths of the extension sequentially from the second end to the first end of the extension. When the one row of terminals is developed into a plane, the shape of the fixing portion 23 of one of the terminals may be reverse-backside seamlessly jointed to the gap region between the elastically moveable portions 21 of the two neighboring terminals. The shape of the extension 22 may be reverse-backside seamlessly jointed to the gap region between the two extensions 22 of the two neighboring terminals. That is, the gap region between the extensions 22 of the two neighboring terminals is equal to the area of the extension 22.

The gap X between the first elastically moveable portion segments of the two neighboring terminals is equal to the width A of the second fixing portion segment. The gap Y between the second elastically moveable portion segments of the two neighboring terminals is equal to the width B of the first fixing portion segment. The gap Z between the first extension segments of the two neighboring terminals is equal to the width C of the second extension segment. The length of the first extension segment 26 is equal to the length of the second extension segment 27. The length of the second elastically moveable portion segment 212 is the same as the length of the first fixing portion segment 28. The width F of the first elastically moveable portion segment plus the width A of the second fixing portion segment is equal to the width D of the first extension segment plus the width C of the second extension segment as well as the width E of the second elastically moveable portion segment plus the width B of the first fixing portion segment. When the one row of terminals is developed into a plane, the shape of the fixing portion 23 may be seamlessly jointed to the gap region between the elastically moveable portions 21 of two neighboring terminals. That is, the first fixing portion segment 28 is seamlessly connected to the second elastically moveable portion segments 212 of the two neighboring terminals, the second fixing portion segment 29 is seamlessly connected to the first elastically moveable portion segments 211 of the two neighboring terminals, and the barb 210 may be seamlessly connected to the concave portions 213 of the two neighboring terminals. In addition, the gap region between the extensions 22 of the two neighboring terminals is equal to the area of the extension 22.

Figure 5:
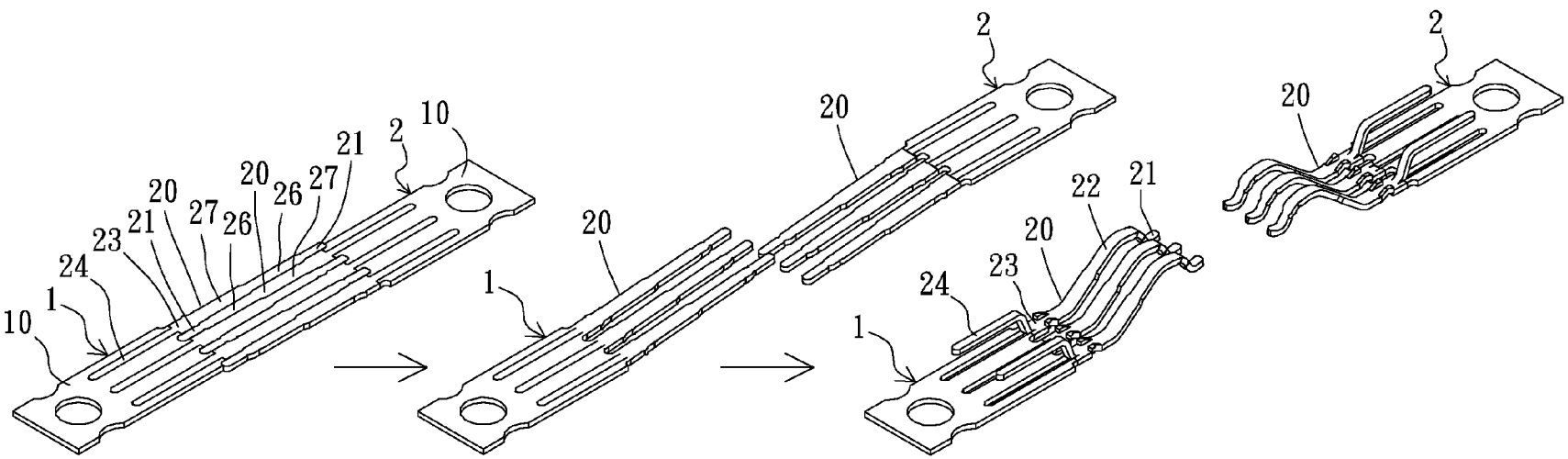
FIG. 5 is a schematic illustration showing the flow of manufacturing the terminals by way of pressing according to the first embodiment of the invention.

According to the above-mentioned structure, the terminals may be manufactured by way of pressing. As shown in FIG. 5, two rows of separately arranged and oppositely connected terminals may be formed by pressing a metal sheet. That is, the fixing portion 23 of each terminal 20 of the first row 1 of terminals may be oppositely connected between the elastically moveable portions 21 of two neighboring terminals 20 of the second row 1 of terminals. The second extension segment 27 of each terminal 20 of the first row 1 of terminals may be oppositely connected between the first extension segments 26 of two neighboring terminals 20 of the second row 1 of terminals. Thus, the metal sheet is firstly completely seamlessly oppositely torn into two rows of terminals, which are then pulled out and bent to form the elastically moveable portions 21, the extensions 22 and the pin portion 24.

In manufacturing the terminals, the two rows of terminals oppositely connected together are pressed so that no further waste product except for the connected material tape 10 is formed. Thus, the material can be significantly saved, and the manufacturing cost may be reduced.

Figure 6:
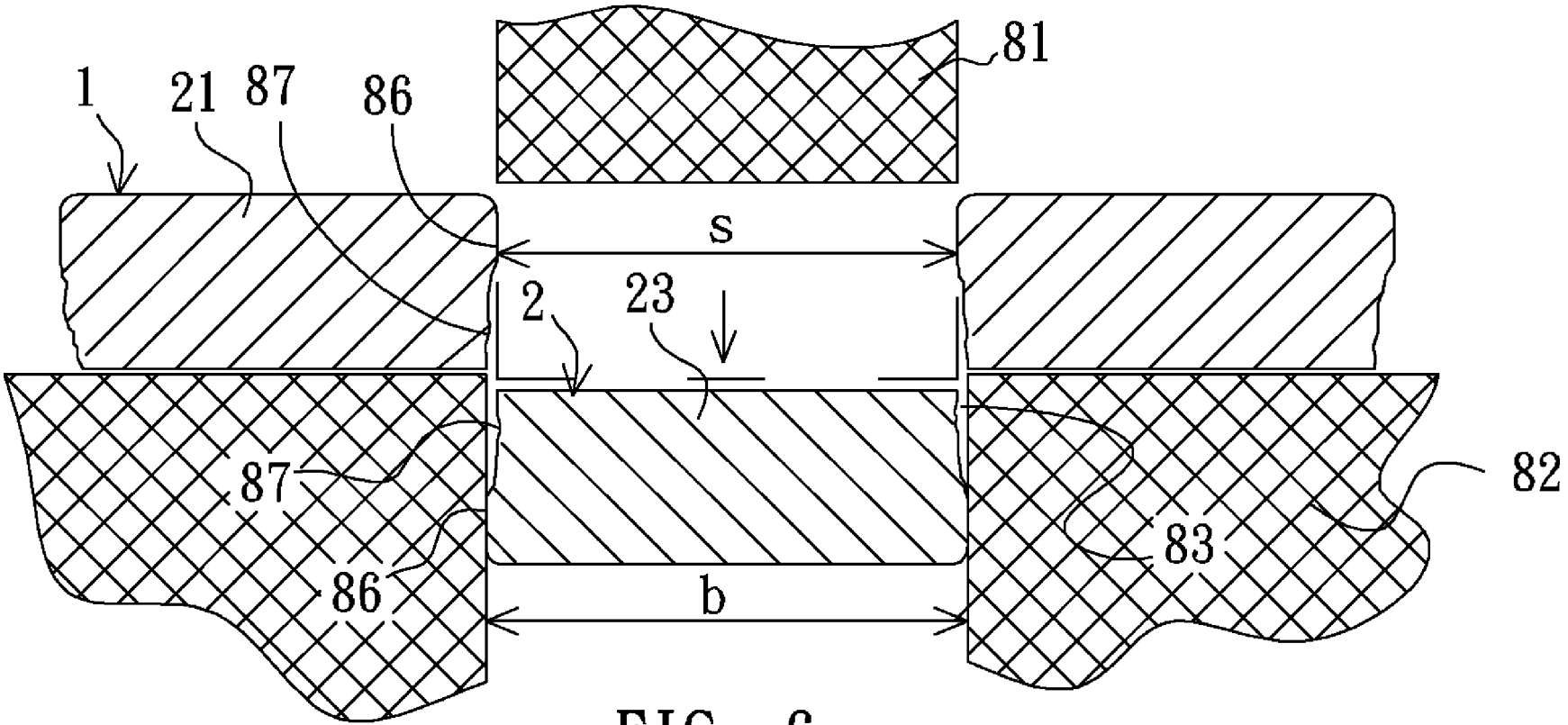
FIG. 6 is a schematic illustration showing the terminals are pressed and manufactured according to the first embodiment of the invention.
Figure 7:
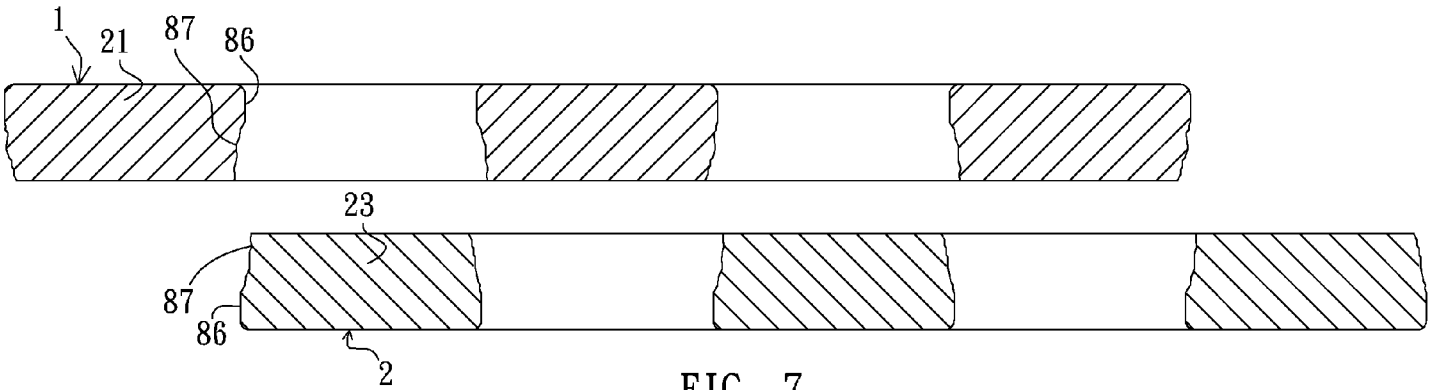
FIG. 7 is a schematic illustration showing cut surfaces of extensions of two rows of terminals according to the first embodiment of the invention.

As shown in FIGS. 6 and 7, when two rows of same terminals are formed by oppositely tearing and pressing a metal sheet, the width s of the upper mold 81 of the mold is inevitably smaller than the width b of the punched hole 83 of the lower mold 82. Because the elastically moveable portions 21 of the terminals of the first row 1 of terminals and the fixing portions 23 of the terminals of the second row 1 of terminals are seamlessly oppositely torn, the cut surface of the elastically moveable portion 21 of the terminal of the first row 1 of terminals has an upper segment formed with a smooth surface 86, and a lower segment formed with a burr 87 after pressing. However, the cut surface of the fixing portion 23 of the terminal of the second row 1 of terminals has a lower segment formed with a smooth surface 86 and an upper segment formed with a burr 87. The width b of the smooth surface 86 is slightly greater than the width s of the burr 87. When the fixing portion 23 of the terminal of the second row 1 of terminals is joined to the gap region between the elastically moveable portions 21 of the terminals of the first row 1 of terminals, the cut surface therebetween is formed by the burr 87 and the smooth surface 86 joined together so that the tight connection may be formed.

Thus, after pressing, the width of the upper segment of the elastically moveable portion 21 of the terminal of the first row 1 of terminals and the width of the lower segment of the fixing portion 23 of the terminal of the second row 2 of terminals are equal to b, while the width of the lower segment of the elastically moveable portion 21 of the terminal of the first row 1 of terminals and the width of the upper segment of the elastically moveable portion of the terminal of the second row 2 of terminals are equal to s. When the terminal 20 of the first row 1 of terminals is rotated by 180 degrees, the cut surface of the fixing portion is the same as the cut surface of the fixing portion of the terminal 20 of the second row 2 of terminals.

Figure 8:
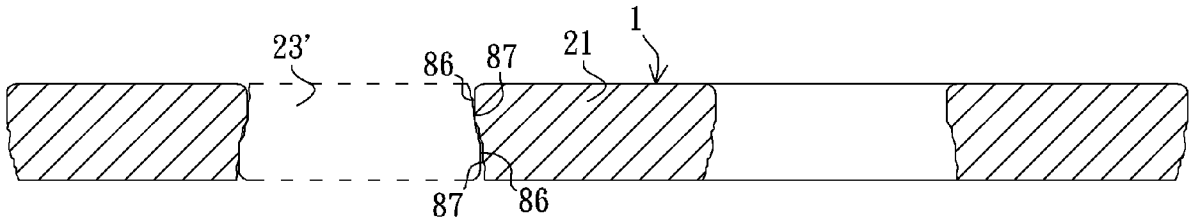
FIG. 8 is a schematic illustration showing the cut surface jointing state between one terminal of the first of terminals and two terminals in a backside-reverse manner according to the first embodiment of the invention.

As shown in FIG. 8, when one terminal of the first row 1 of terminals is joined between two terminals in a backside-reverse manner, the cut surface of its fixing portion 23' and the cut surfaces of the elastically moveable portions 21 of the two neighboring terminals are respectively the burr 87 and the smooth surface 86 joined together so that the tight connection may be formed.

Figure 9:
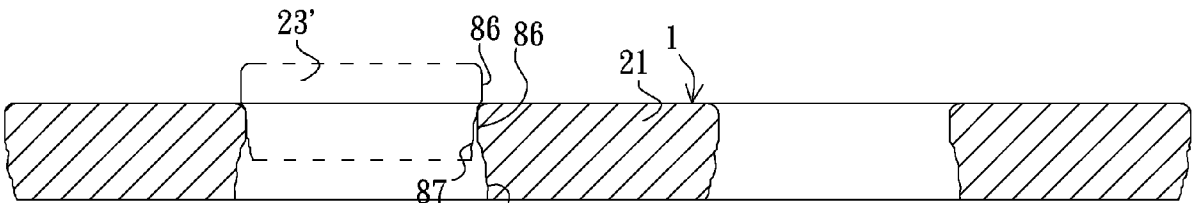
FIG. 9 is a schematic illustration showing the cut surface jointing state between one terminal of the first row of terminals and two terminals in a front-side-reverse manner according to the first embodiment of the invention.

As shown in FIG. 9, when one terminal of the first row 1 of terminals is reversely joined between two terminals on the same surface, the cut surface of its fixing portion and the cut surfaces of the elastically moveable portions of the two neighboring terminals 20 are respectively the smooth surfaces 86 joined together so that the tight connection cannot be formed.

Figure 10:
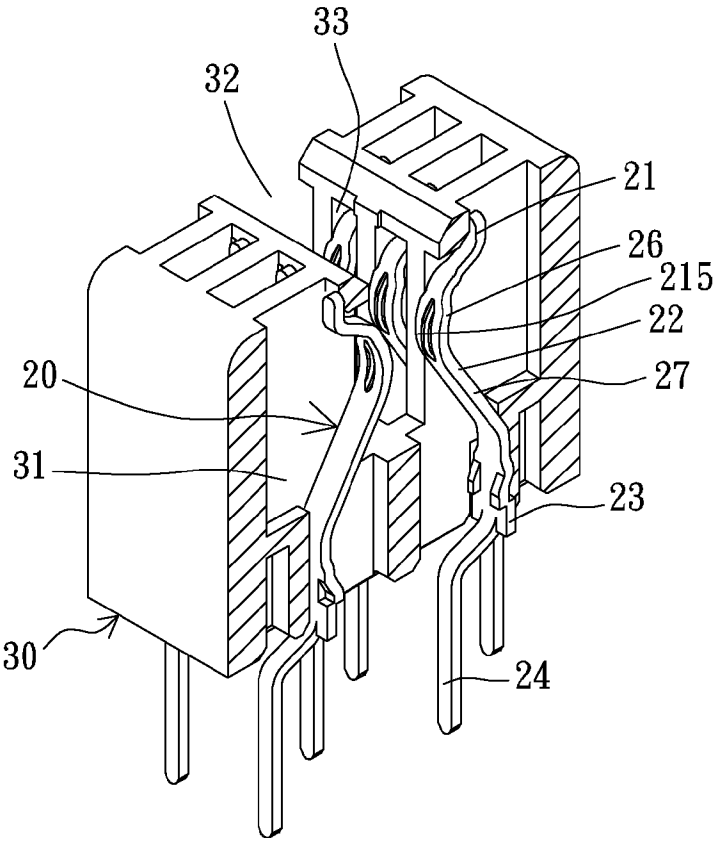
FIG. 10 is a pictorially assembled view showing a second embodiment of the invention.

As shown in FIG. 10, the second embodiment of the invention is almost the same as the first embodiment except that the plate surface of the first extension segment 26 of the terminal 20 is prodded and pressed to form a projecting connection point 215.

Figure 12:
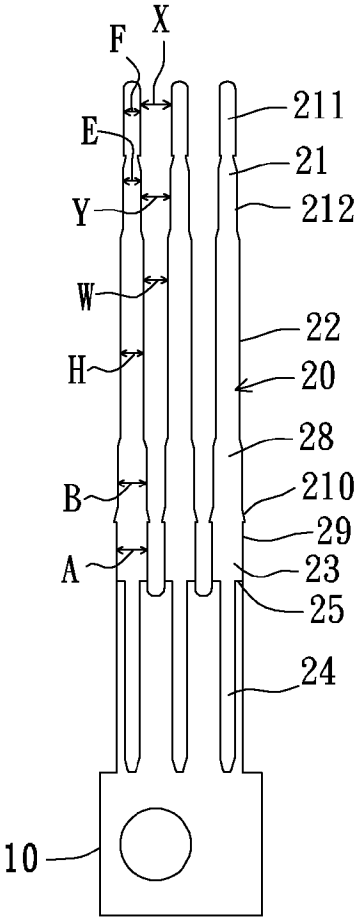
FIG. 12 is a developed plane view showing the terminals according to the third embodiment of the invention.
Figure 11:
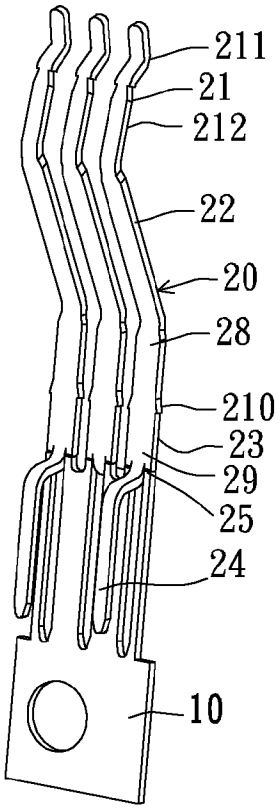
FIG. 11 is a pictorial view showing the terminals according to a third embodiment of the invention.

As shown in FIGS. 11 and 12, the third embodiment of the invention is almost the same as the first embodiment except that the extension 22 of the terminal 20 only has the width H of one extension. The gap W between the extensions of the two neighboring terminals is equal to the width H of the extension. The length of the second elastically moveable portion segment 212 is the same as the length of the first fixing portion segment 28. The width F of the first elastically moveable portion segment plus the width A of the second fixing portion segment is equal to two times of the width H of the extension as well as the width E of the second elastically moveable portion segment plus the width B of the first fixing portion segment.

Figure 13:
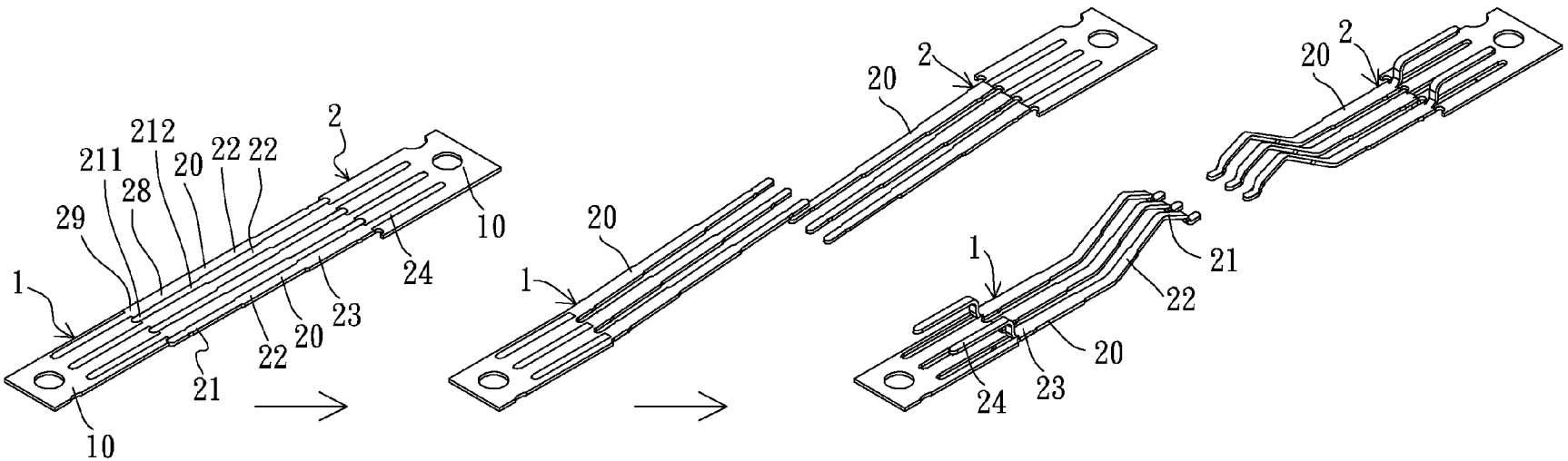
FIG. 13 is a schematic illustration showing the flow of manufacturing the terminals by way of pressing according to the third embodiment of the invention.

The terminals of this embodiment are manufactured by way of pressing. As shown in FIG. 13, two rows of separately arranged but completely oppositely connected terminals may be formed by pressing a metal sheet. That is, the second fixing portion segment 29 of each terminal 20 of the first row 1 of terminals may be oppositely connected between the first elastically moveable portion segments 211 of the two neighboring terminals 20 of the second row 2 of terminals. The first fixing portion segment 28 of each terminal 20 of the first row 1 of terminals may be oppositely connected between the second elastically moveable portion segments 212 of the two neighboring terminals 20 of the second row 2 of terminals. The extension 22 of each terminal 20 of the first row 1 of terminals may be oppositely connected between the extensions 22 of the two neighboring terminals 20 of the second row 2 of terminals. Thus, a metal sheet is firstly completely seamlessly oppositely torn into two rows of terminals, which are then pulled out and bent to form the elastically moveable portion 21, the extension 22 and the pin portion 24.

Figure 14:
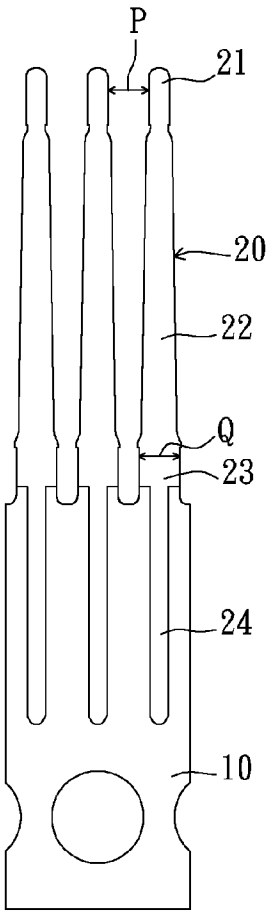
FIG. 14 is a developed plane view showing the terminals according to a fourth embodiment of the invention.

As shown in FIG. 14, the fourth embodiment of the invention is almost the same as the first embodiment except that the fixing portions 23 of the terminal 20 have the same width, while the elastically moveable portions 21 also have the same width. The width of the extension 22 is gradually increased from top to bottom. The gap P between the elastically moveable portions of the two neighboring terminals is equal to the width Q of the fixing portion. When the terminal 20 is developed into a plane, the gap region between the extensions 22 of the two neighboring terminals is equal to the area of the extension 22. According to the above-mentioned structure, two rows of separately arranged and oppositely connected terminals may be formed by pressing one metal sheet.

Figure 15:
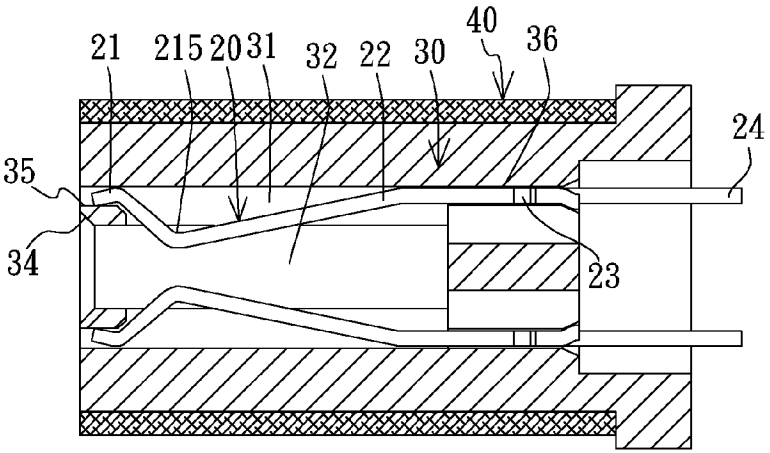
FIG. 15 is a cross-sectional side view showing a fifth embodiment of the invention.
Figure 16:
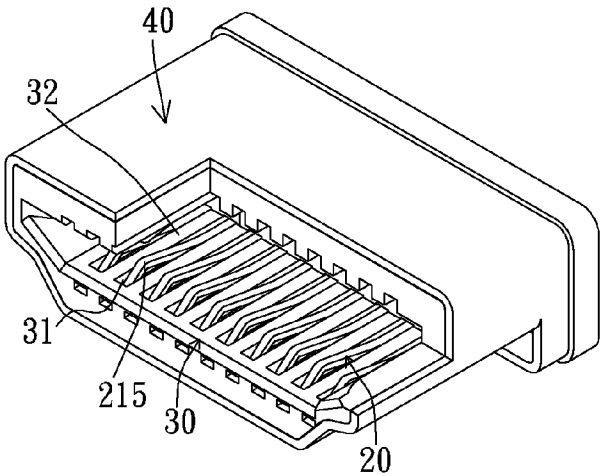
FIG. 16 is a pictorially cross-sectional view showing the fifth embodiment of the invention.

As shown in FIGS. 15 and 16, the fifth embodiment of the invention is a plug of a signal cable and includes a plastic base 30, two rows of terminals 20 and a metal casing 40.

The plastic base 30 has two rows of separately arranged terminal slots 31, which are arranged in a vertical direction and face each other. A connection slot 32 is formed between the two rows of terminal slots 31. The terminal slot 31 extends in a direction from front to rear and communicates with the connection slot 32. The front end of the connection slot 32 is formed with an insert port and has a guide-in slant surface 34. The rear end of the terminal slot 31 has an engaging slot 36, and the front end of the terminal slot has a resting surface 35.

The two rows of terminals 20 are disposed in the two rows of terminal slots 31 of the plastic base 30. The terminal 20 has an elastically moveable portion 21, an extension 22, a fixing portion 23 and a pin portion 24 from one end to the other end. The structure of the terminal 20 of this embodiment is almost the same as that of the first embodiment. The extension 22 has first and second ends, the extension 22 has first and second ends and the fixing portion 23 has first and second ends. The first end of the elastically moveable portion 21 is the tail end of the terminal. The second end of the elastically moveable portion 21 is connected to the first end of the extension 22. The second end of the extension 22 is connected to the first end of the fixing portion 23. The second end of the fixing portion 23 is connected to the pin portion 24 and a material tape 10, and a cut mark 25 that may be easily broken is formed on the connection portion. The width of the fixing portion 23 is greater than the width of the extension 22 so that the fixing portion 23 is engaged with the engaging slot 36 of the terminal slot 31. The elastically moveable portion 21 elastically rests against the resting surface 35 of the plastic base. The difference between this embodiment and the first embodiment resides in that the terminal 20 of this embodiment extends transversally. The extension 22 has the same width from the first end to the second end thereof. The extension 22 transversally extends into a bent elastic arm and may elastically move up and down. A projecting connection point 215 is formed near a distal end of the extension, and the connection point 215 extends from the terminal slot 31 to the connection slot 32.

The metal casing 40 covers the plastic base 30.

Figure 17:
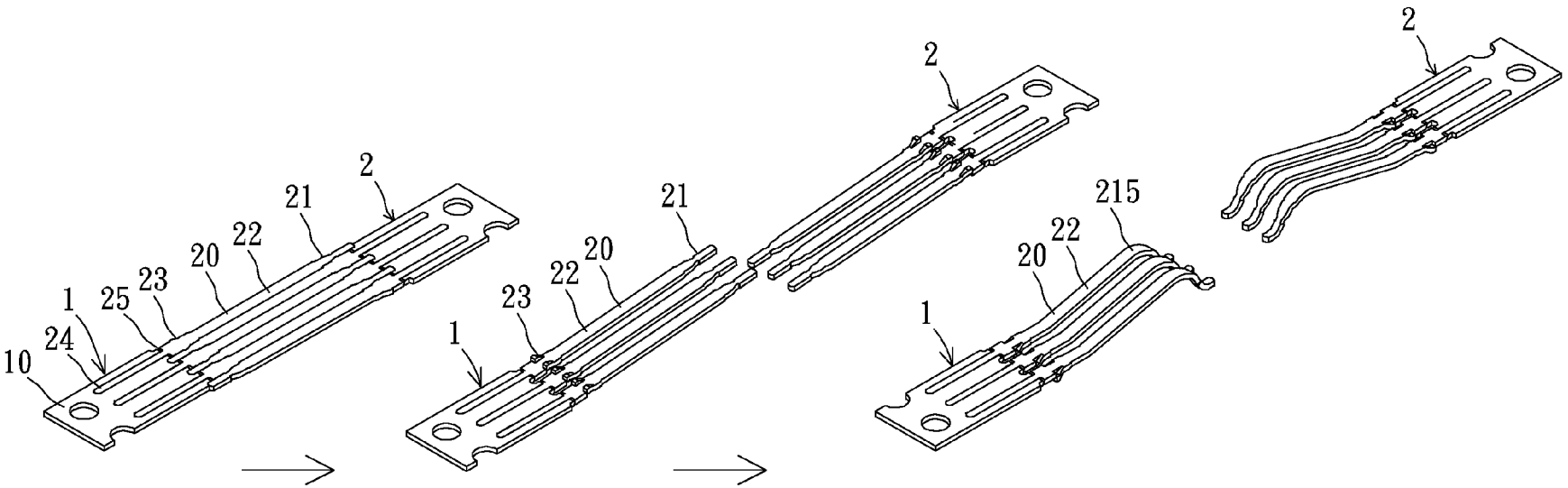
FIG. 17 is a schematic illustration showing the flow of manufacturing the terminals by way of pressing according to the fifth embodiment of the invention.
Figure 21:
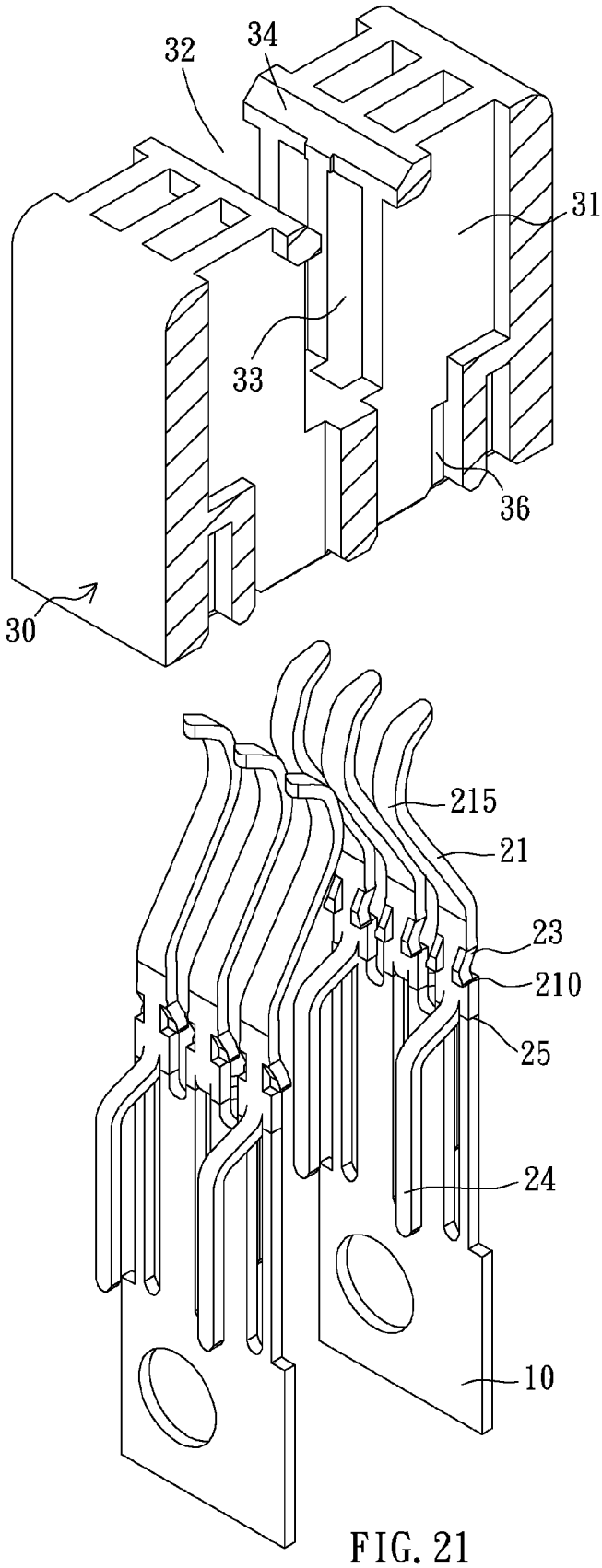
FIG. 21 is a pictorially exploded view showing a seventh embodiment of the invention.

FIG. 17 is a schematic illustration showing the flow of manufacturing the terminals by way of pressing according to the fifth embodiment of the invention. As shown in FIG. 17, the structure of the terminals 20 of this embodiment is almost the same as that of the first embodiment because the gaps between the elastically moveable portions 21 of the two neighboring terminals sequentially from the first ends to the second ends of the elastically moveable portions 21 are equal to the widths of the fixing portion 23 sequentially from the second end to the first end of the fixing portion 23, and the gaps between the extensions of the two neighboring terminals sequentially from the first ends to the second ends of the extensions are equal to the widths of the extension sequentially from the second end to the first end of the extension. When the one row of terminals is developed into a plane, the shape of the fixing portion 23 of one of the terminals may be reverse-backside seamlessly jointed to the gap region between the elastically moveable portions 21 of the two neighboring terminals, and the shape of the extension 22 of the terminal may be reverse-backside seamlessly jointed to the gap region between the extensions 22 of the two neighboring terminals.

According to the above-mentioned structure, two rows of separately arranged and oppositely connected terminals may be formed by pressing one metal sheet. The extension 22 and the fixing portion 23 of each terminal 20 of the first row 1 of terminals are respectively seamlessly oppositely connected between the elastically moveable portions 21 and the extensions 22 of the two neighboring terminals 20 of the second row 2 of terminals. Thus, the metal sheet is firstly oppositely cut into the first and second rows 1 and 2 of terminals, which are then separated and bent into the extensions 22.

As shown in FIGS. 18 to 20, the sixth embodiment of the invention is an express card connector including a plastic base 30, one row of terminals 20 and one upper metal cover 45.

The plastic base 30 has one row of separated arranged terminal slots 31 and a connection slot 32. The terminal slot 31 extends in a back-and-forth direction and communicates with the connection slot 32. The front end of the terminal slot 31 is also formed with a resting surface 35 and the rear end of the terminal slot 31 is formed with an engaging slot.

The one row of terminals 20 is disposed in the one row of terminal slots 31 of the plastic base 30. The terminal 20 has an elastically moveable portion 21, an extension 22, a fixing portion 23 and a pin portion 24 from one end to the other end. The structure of the terminal 20 is almost the same as that of the fifth embodiment. The extension 22 is also elastically moveable in a vertical direction. The difference therebetween is that the pin portion 24 of this embodiment is bent downward to then form a horizontal pin.

The upper metal cover 45 covers over the plastic base 30 and has a top surface 46 and opposite first and second side surfaces 47 and 48.

The structure of the terminal 20 of this embodiment is almost the same as that of the fifth embodiment. Similarly, the gaps between the elastically moveable portions 21 of the two neighboring terminals sequentially from the first ends to the second ends of the elastically moveable portions 21 are equal to the widths of the fixing portion 23 sequentially from the second end to the first end of the fixing portion 23. In addition, the gaps between the extensions of the two neighboring terminals sequentially from the first ends to the second ends of the extensions are equal to the widths of the extension sequentially from the second end to the first end of the extension. When the one row of terminals is developed into a plane, the shape of the fixing portion 23 of one of the terminals may be reverse-backside seamlessly jointed to the gap region between the elastically moveable portions 21 of the two neighboring terminals, and the shape of the extension 22 of the terminal may be reverse-backside seamlessly jointed to the gap region between the extensions 22 of the two neighboring terminals. Thus, the terminals may be formed by way of pressing and the material may be saved.

As shown in FIGS. 21 to 24, the seventh embodiment of the invention is a memory card module connector including a plastic base 30 and two rows of terminals 20.

The plastic base 30 is longitudinal and has two rows of separately arranged terminal slots 31 separated by a gap and facing each other, wherein a longitudinal connection slot 32 is formed between the terminal slots 31. The terminal slot 31 extends in a vertical direction and has an opening 33 communicating with the connection slot 32. The opening of the connection slot 32 faces upward and the upper end of the connection slot 32 is formed with a guide-in slant surface 34. A lower segment of the terminal slot 31 has an engaging slot 36.

The two rows of terminals 20 are disposed in the two rows of terminal slots 31 of the plastic base 30. Each row of terminals 20 is connected to a material tape 10. After the one row of terminals 20 is assembled in the one row of terminal slots 31, the material tape 10 is broken for separation. The terminal 20 has an elastically moveable portion 21, a fixing portion 23 and a pin portion 24 from one end to the other end. The lower end of the fixing portion 23 is connected to the material tape 10 and a cut mark 25 is formed therebetween. The width of the fixing portion 23 is greater than the width of the elastically moveable portion 21 and the width of the pin portion 24. The fixing portion 23 has a barb 210 with a greater width so that it can be engaged with the engaging slot 36 of the terminal slot 31. The elastically moveable portion 21 having one single width has first and second ends 221 and 222, wherein the second end 222 is connected to the fixing portion, and the first end 221 is an open end. The elastically moveable portion 21 extends in a vertical direction to form a bent elastic arm which may elastically move laterally. A projecting connection point 215 is disposed near a distal end of the elastically moveable portion 21. The connection point 215 extends out of the terminal slot 31 from the opening 33 to the connection slot 32, and the pin portion 24 extends out of the lower end of the plastic base 30.

The feature of this embodiment resides in that each row of terminals is one of two same rows of terminals formed by oppositely tearing and pressing a metal sheet. The terminals of the two rows of terminals have oppositely torn and cut portions seamlessly oppositely connected together. When the one row of terminals is developed into a plane and one of the terminals is reverse-backside joined between the two neighboring terminals, the oppositely torn and cut portion of the terminal is seamlessly jointed to the oppositely torn and cut portions of the two neighboring terminals. The oppositely torn and cut portion of this embodiment is the elastically moveable portion 21.

The gap A between the elastically moveable portions 21 of the two neighboring terminals of the same row of terminals is equal to the width B of the elastically moveable portion 21. That is, when the one row of terminals is developed into a plane, the shape of the elastically moveable portion 21 of one of the terminals may be reverse-backside seamlessly jointed to the gap region between the elastically moveable portions 21 of the two neighboring terminals.

Figure 25:
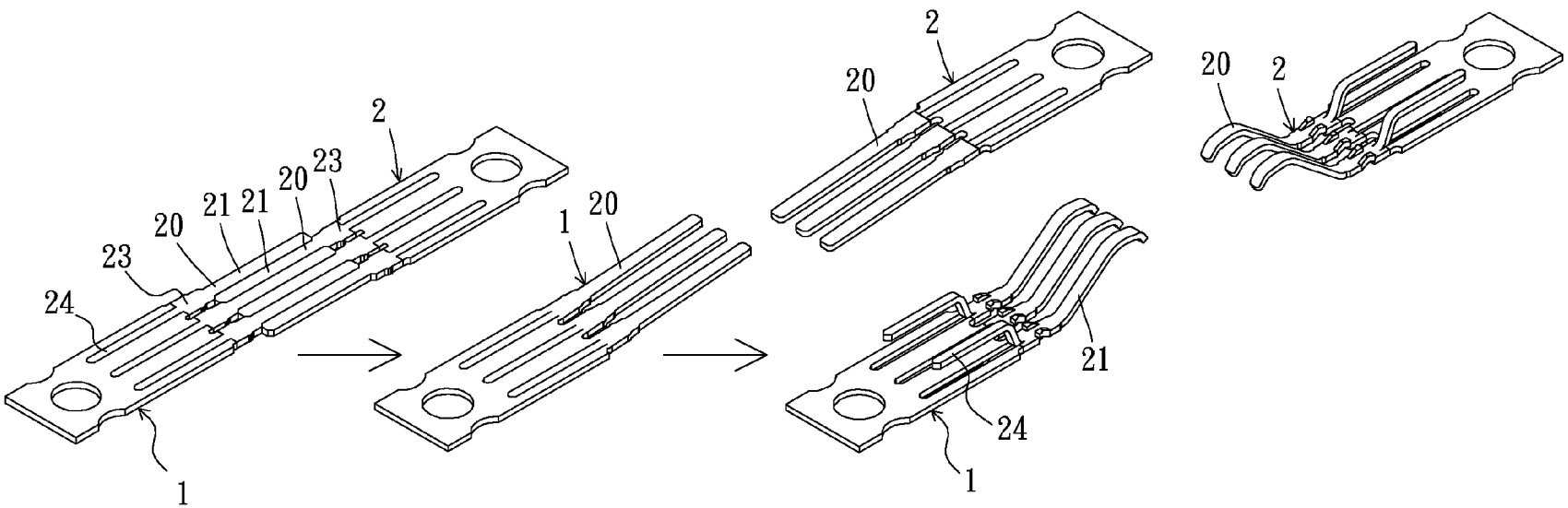
FIG. 25 is a schematic illustration showing the flow of manufacturing the terminals by way of pressing according to the seventh embodiment of the invention.

According to the above-mentioned structure, the terminals may be formed by way of pressing. As shown in FIG. 25, two rows of separately arranged and oppositely connected terminals may be formed by pressing one metal sheet. The elastically moveable portion 21 of each terminal 20 of the first row 1 of terminals is seamlessly oppositely connected between the elastically moveable portions 21 of the two neighboring terminals 20 of the second row 2 of terminals. So, the metal sheet is firstly oppositely cut into first and second rows 1 and 2 of terminals, which are then separated and bent to form the elastically moveable portions 21 and the pin portions 24.

In manufacturing the terminals, when two rows of terminals oppositely connected together are pressed, the material can be significantly saved and the manufacturing cost may be reduced because the extensions of the two rows of terminals are seamlessly jointed together and the length of the elastically moveable portion 21 occupies a greater portion of the overall terminal.

Figure 22:
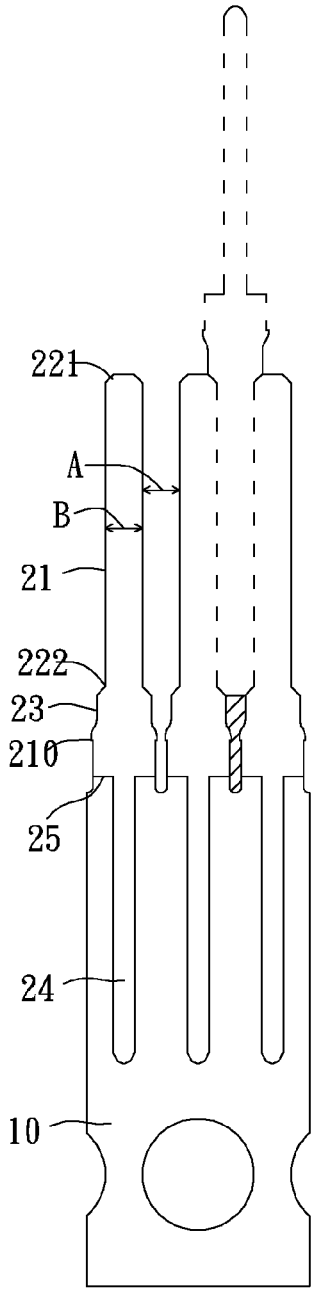
FIG. 22 is a developed plane view showing one row of terminals according to the seventh embodiment of the invention.
Figure 23:
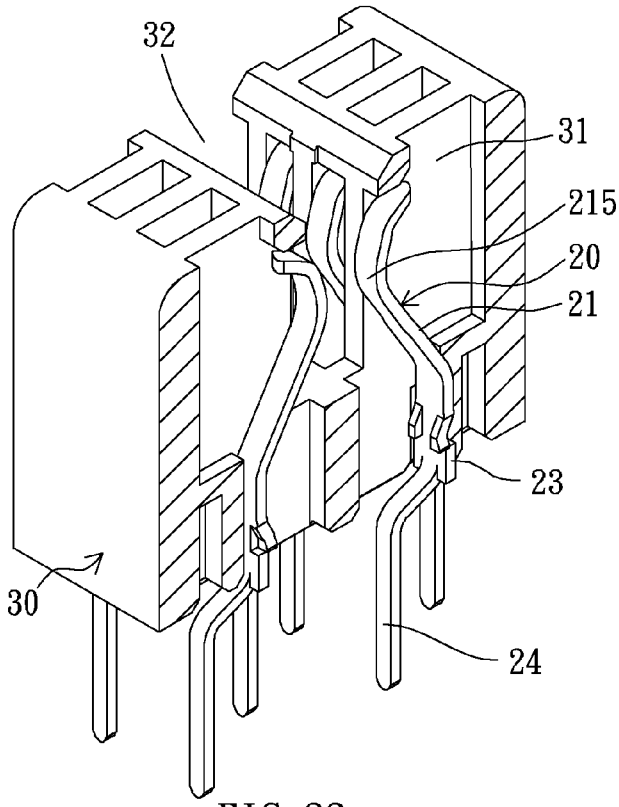
FIG. 23 is a pictorially assembled view showing the seventh embodiment of the invention.
Figure 24:
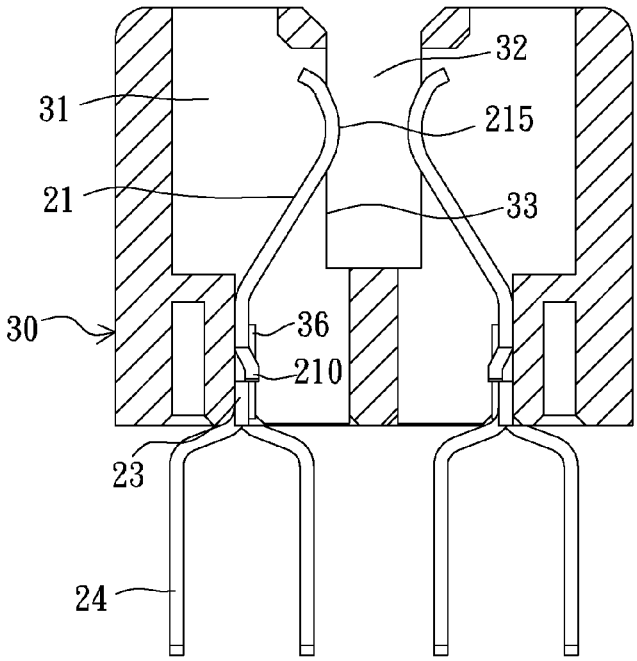
FIG. 24 is an assembled cross-sectional view showing the seventh embodiment of the invention.

Although the fixing portions 23 of the two rows of terminals are not oppositely connected together, the pressed waste product becomes less because the width of the fixing portion 23 is very large. The hatched portion of FIG. 22 represents the pressed waste product between the fixing portions of the two neighboring terminals.

Figure 26:
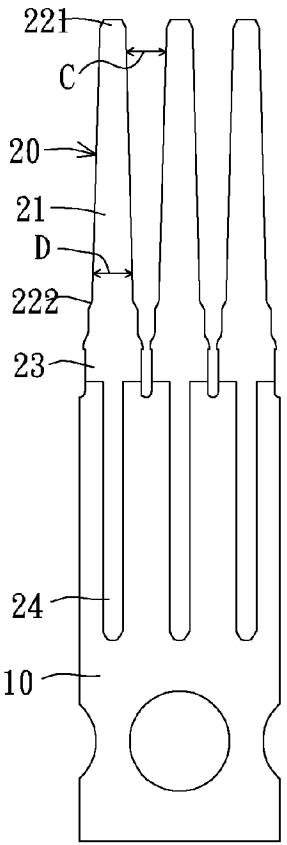
FIG. 26 is a developed plane view showing the terminals according to an eighth embodiment of the invention.

As shown in FIG. 26, the eighth embodiment of the invention is almost the same as the seventh embodiment except that the width of the elastically moveable portion 21 of the terminal 20 of this embodiment gradually increases from the first end 221 to the second end 222. The gaps C between the elastically moveable portions 21 of the two neighboring terminals 20 of the same row sequentially from the first ends 221 to the second ends 222 are equal to the widths D of the elastically moveable portion 21 sequentially from the second end 222 to the first end 221. That is, when the one row of terminals is developed into a plane, the shape of the elastically moveable portion 21 of one of the terminals may be reverse-backside seamlessly jointed to the gap region between the elastically moveable portions 21 of the two neighboring terminals.

Figure 27:
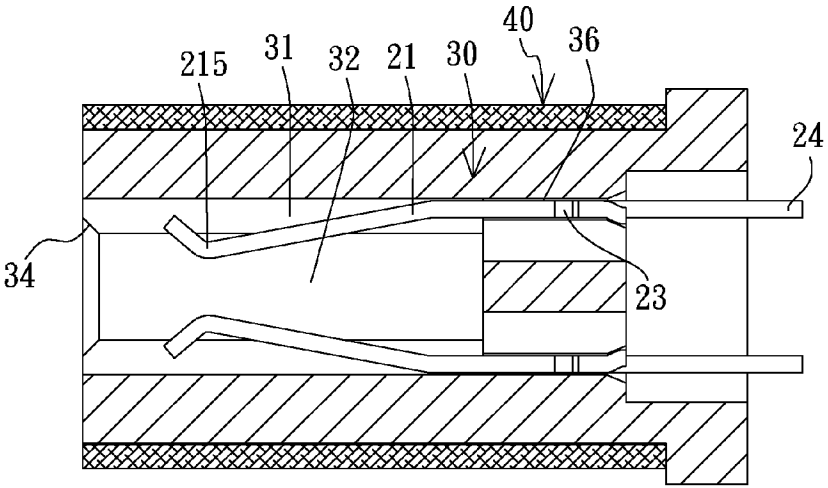
FIG. 27 is a cross-sectional side view showing a ninth embodiment of the invention.
Figure 28:
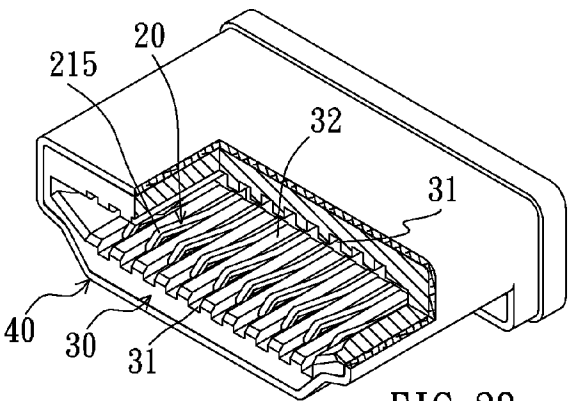
FIG. 28 is a pictorially cross-sectional view showing the ninth embodiment of the invention.

As shown in FIGS. 27 and 28, the ninth embodiment of the invention is a plug of a signal cable and includes a plastic base 30, two rows of terminals 20 and a metal casing 40.

The plastic base 30 has two rows of separately arranged terminal slots 31 arranged in a vertical direction and facing each other. A connection slot 32 is formed between the two rows of terminal slots 31. The terminal slot extends in a back-and-forth direction and communicates with the connection slot 32. The front end of the connection slot 32 is formed with an insert port and a guide-in slant surface 34. The rear end of the terminal slot 31 is formed with an engaging slot 36.

The two rows of terminals 20 are disposed in the two rows of terminal slots 31 of the plastic base 30. The terminal 20 has an elastically moveable portion 21, a fixing portion 23 and a pin portion 24 from one end to the other end. The width of the fixing portion 23 is greater than the width of the elastically moveable portion 21 and the width of the pin portion 24 so that the fixing portion 23 can be engaged with the engaging slot 36 of the terminal slot 31. The elastically moveable portion 21 transversally extends to form a bent elastic arm that may elastically move up and down. A projecting connection point 215 is formed near a distal end of the elastically moveable portion 21. The connection point 215 extends from the terminal slot 31 to the connection slot 32, and the pin portion 24 extends out of the plastic base 30.

The metal casing 40 covers over the plastic base 30.

Figure 29:
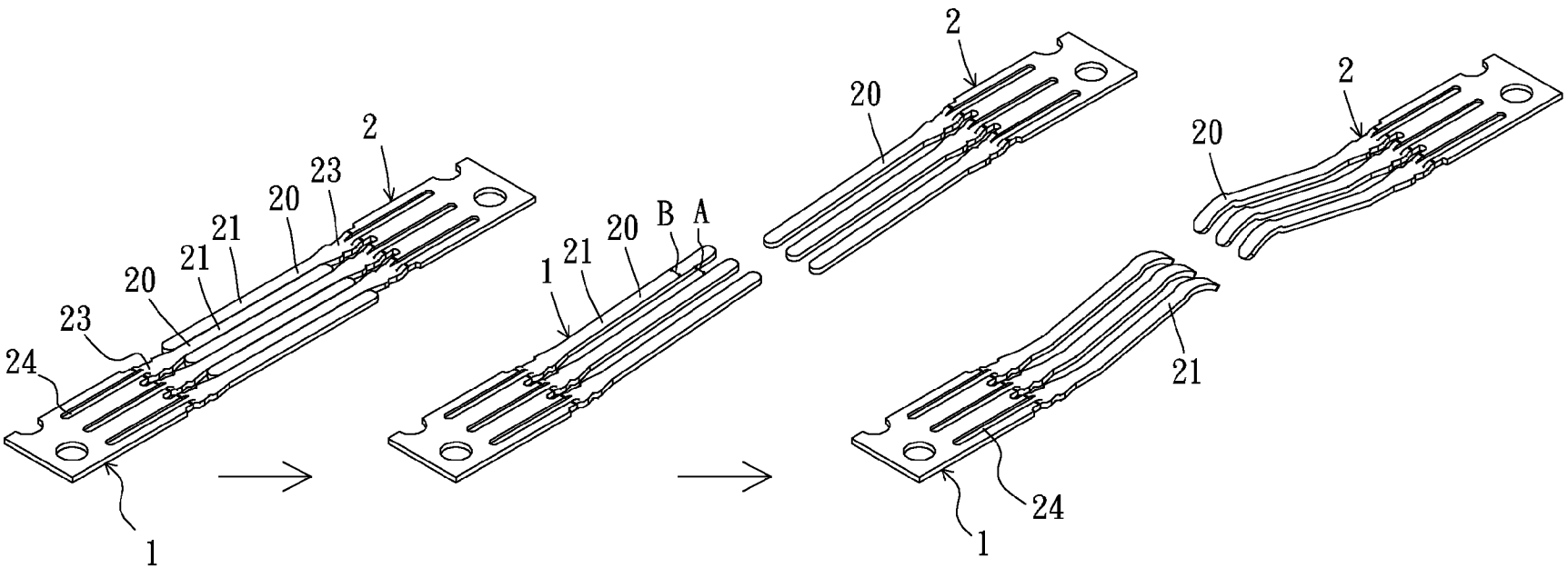
FIG. 29 is a schematic illustration showing the flow of manufacturing the terminals by way of pressing according to the ninth embodiment of the invention.

FIG. 29 is a schematic illustration showing the flow of manufacturing the terminals by way of pressing according to the ninth embodiment of the invention. As shown in FIG. 29, the structure of the terminals 20 of this embodiment is almost the same as that of the seventh embodiment. Similarly, the gap A between the elastically moveable portions 21 of the same row of two neighboring terminals is equal to the width B of the elastically moveable portion 21. That is, when the one row of terminals is developed into a plane, the shape of the elastically moveable portion 21 can be reversely seamlessly jointed to the gap region between the elastically moveable portion 21 of the two neighboring terminals. According to the above-mentioned structure, two rows of the terminals oppositely connected together may be manufactured by pressing the same metal sheet. The elastically moveable portion 21 of each terminal 20 of the first row 1 of terminals is seamlessly oppositely connected between the elastically moveable portions 21 of the two neighboring terminals 20 of the second row 2 of terminals. Thus, the metal sheet is firstly oppositely cut into first and second rows 1 and 2 of terminals, which are then separated and bent to form the elastically moveable portions 21.

Figure 30:
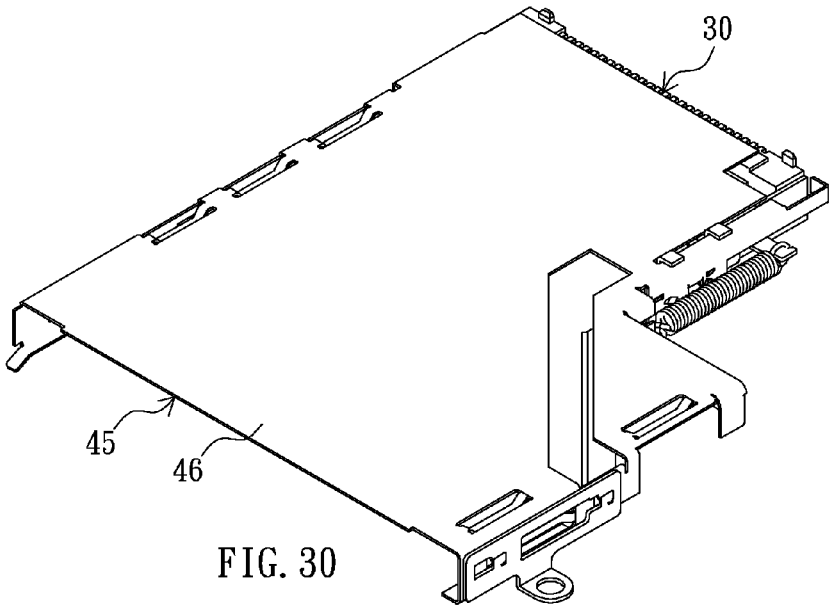
FIG. 30 is a pictorial front view showing a tenth embodiment of the invention.
Figure 31:
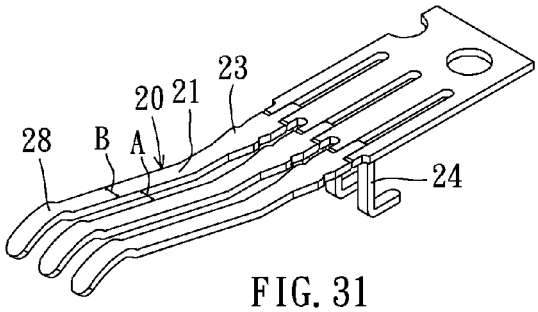
FIG. 31 is a pictorial view showing one row of terminals according to the tenth embodiment of the invention.
Figure 32:
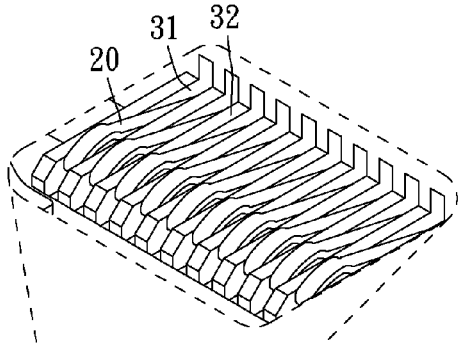
FIG. 32 is a pictorial view showing the backside according to the tenth embodiment of the invention.
Figure 32:
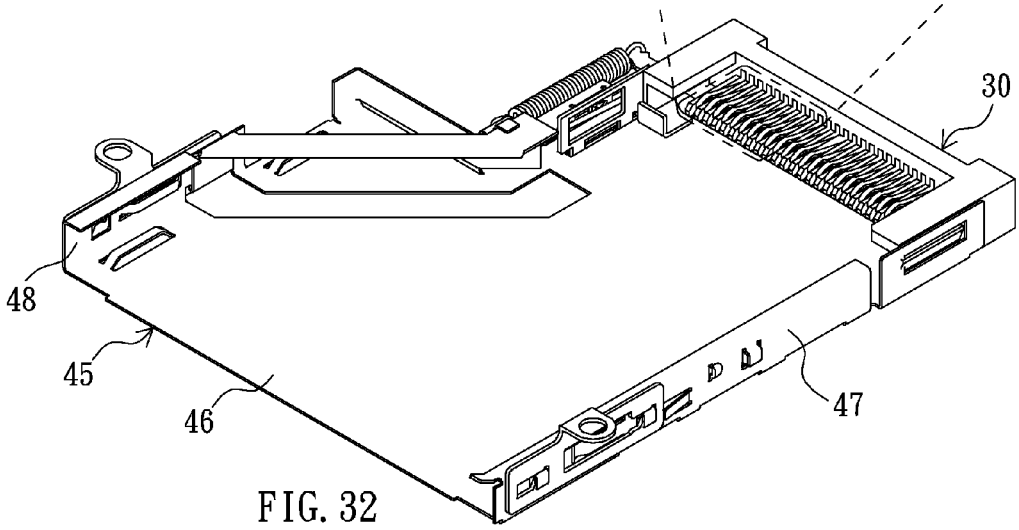
Figure 33:
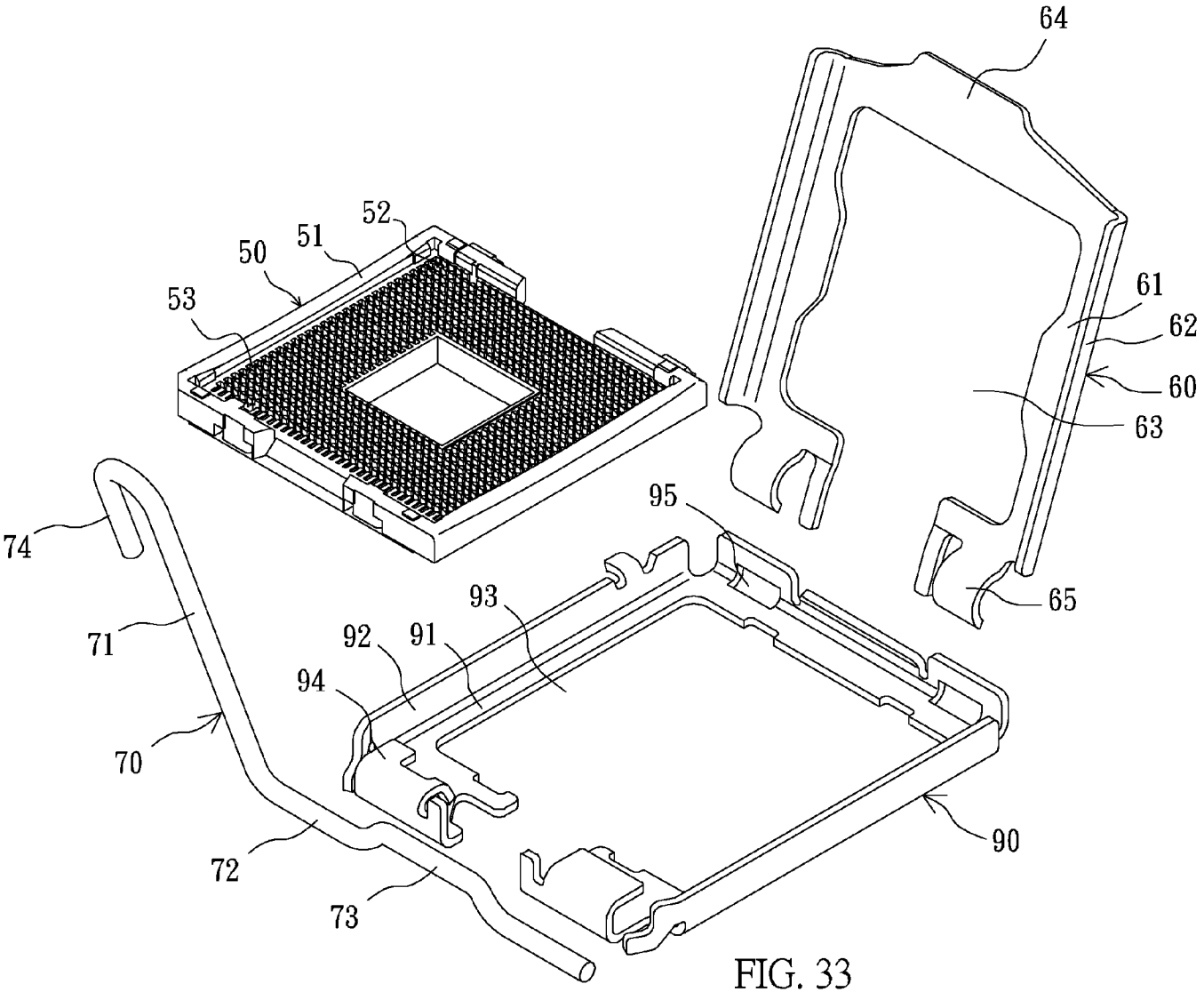
FIG. 33 is a pictorially exploded view showing an eleventh embodiment of the invention.
Figure 34:
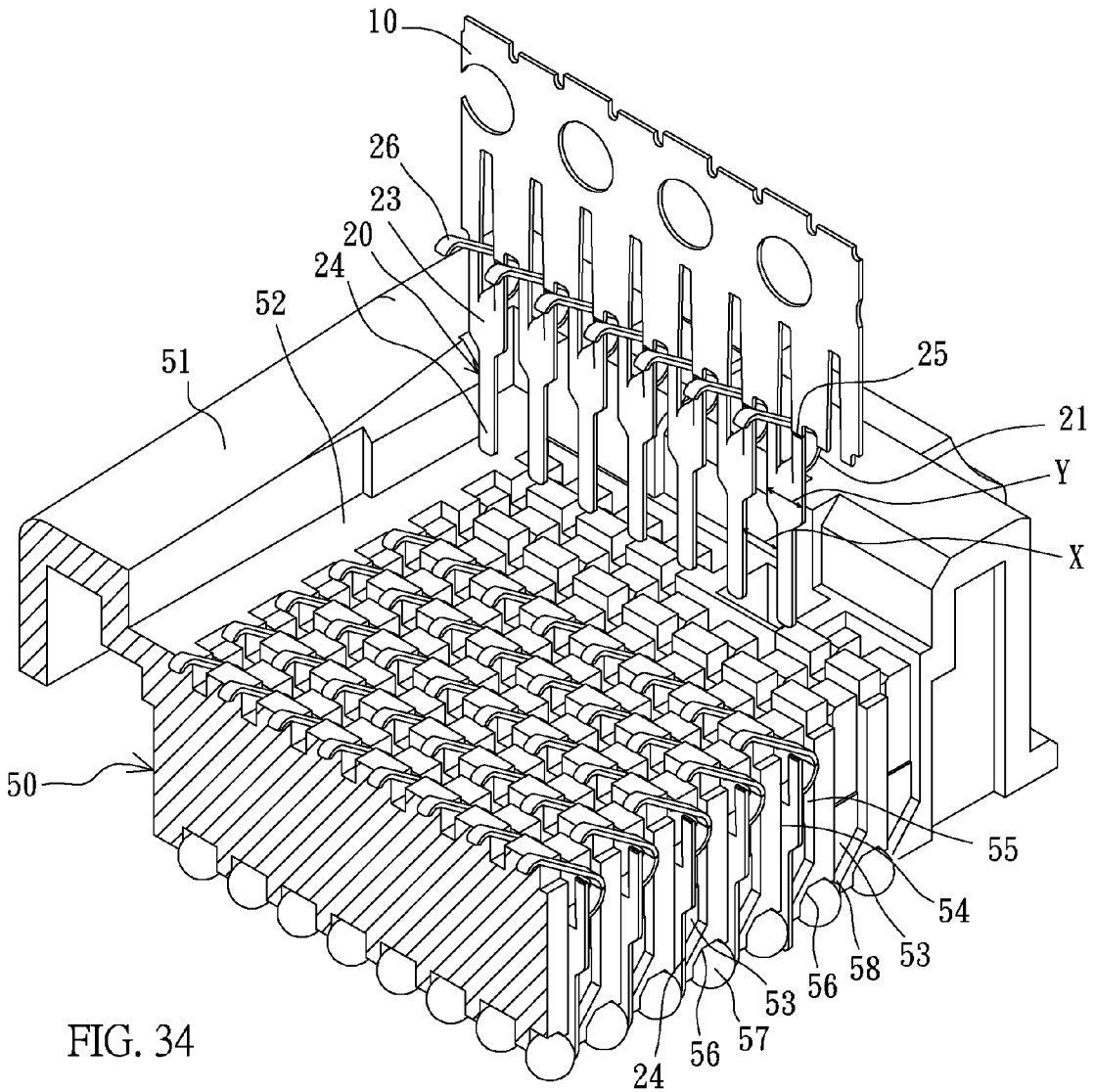
FIG. 34 is a pictorially exploded view showing the terminals and the plastic base according to the eleventh embodiment of the invention.
Figure 35:
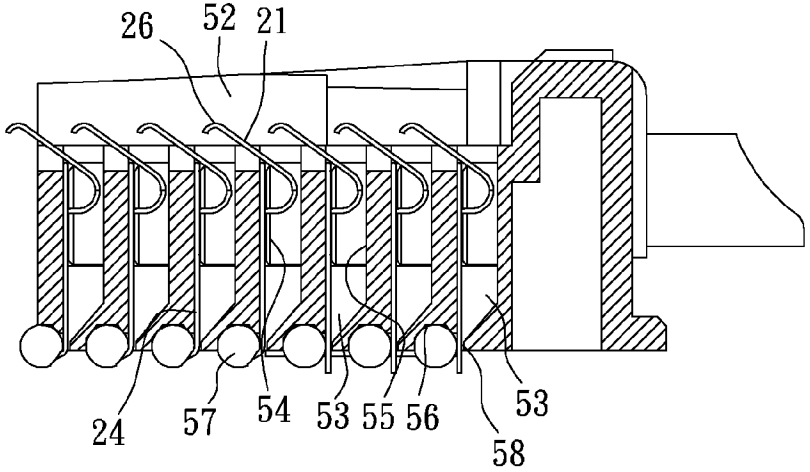
FIG. 35 is a cross-sectional view showing the eleventh embodiment of the invention.
Figure 36:
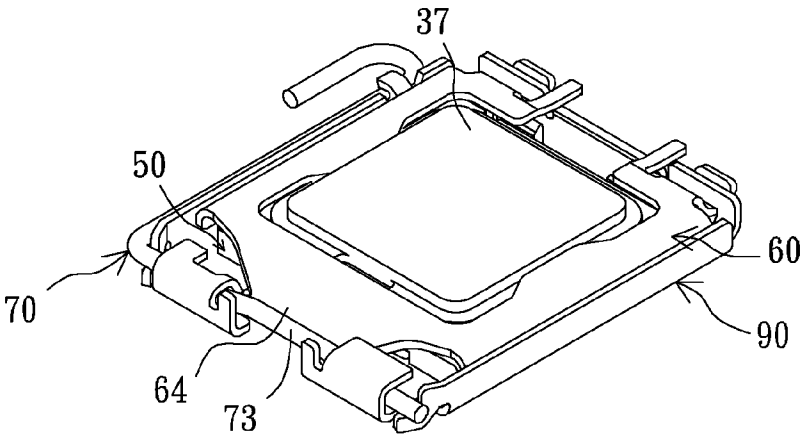
FIG. 36 is a pictorial view showing a usage state according to the eleventh embodiment of the invention.

As shown in FIGS. 30 to 32, the tenth embodiment of the invention is an express card connector and includes a plastic base 30, one row of terminals 20 and an upper metal cover 45.

The plastic base 30 has one row of separately arranged terminal slots 31 and a connection slot 32. The terminal slot 31 extends in a back-and-forth direction and communicates with the connection slot 32.

The one row of terminals 20 is disposed in the one row of terminal slots 31 of the plastic base 30. The terminal 20 has an elastically moveable portion 21, a fixing portion 23 and a pin portion 24 from one end to the other end. The width of the fixing portion 23 is greater than the width of the elastically moveable portion 21 and the width of the pin portion 24 so that the fixing portion 23 may be engaged with the engaging slot of the terminal slot 31. The elastically moveable portion 21 extends transversally to form a bent elastic arm and may elastically move up and down. A projecting connection point 215 is formed near a distal end of the elastically moveable portion 21. The connection point 215 extends from the terminal slot 31 to the connection slot 32, and the pin portion 24 extends out of the lower end of the plastic base 30.

The upper metal cover 45 covers over the plastic base 30 and has a top surface 46 and opposite first and second side surfaces 47 and 48.

The structure of the terminals 20 of this embodiment is almost the same as that of the ninth embodiment. Similarly, the gap A between the elastically moveable portions 21 of two neighboring terminals of the same row is equal to the width B of the elastically moveable portion 21. That is, when the one row of terminals is developed into a plane, the shape of the elastically moveable portion 21 of one of the terminals may be reverse-backside seamlessly jointed to the gap region between the elastically moveable portions 21 of the two neighboring terminals so that the material is saved when manufacturing the terminals by way of pressing.

As shown in FIGS. 33 to 36, the eleventh embodiment of the invention is a chip connector and includes an external metal seat 90, an internal plastic seat 50, an upper metal cover 60, a lever 70 and multiple rows of terminals 20.

The external metal seat 90 has a bottom surface 91 and two side surfaces 92 extending upwards. The middle of the bottom surface 91 is formed with a window 93. Two sides of the front end of the window 93 are formed with first pivot portions 94, and two sides of the rear end of the window 93 are formed with second pivot portions 95.

The internal plastic seat 50 is disposed on the external metal seat 90. The upper periphery of the internal plastic seat 50 is formed with flanges 51 extending upwards to surround a placement region 52, in which a chip may be placed. The placement region 52 has multiple rows of separately arranged terminal slots 53 corresponding to the window 93. Each terminal slot 53 has a first wall 54 and a second wall 55 for separating the terminal slot 53 from the front and rear rows of terminal slots. A solder ball slot 56 is correspondingly disposed below the terminal slot 53. A solder ball 57 is disposed in the solder ball slot 56. The terminal slots 53 communicate with the solder ball slots 56 through channels 58, respectively.

The upper metal cover 60 has a top surface 61 and two side surfaces 62 extending downwards. The middle of the top surface 61 is formed with a window 63. The front end of the window 63 is formed with a tab 64, and two sides of the rear end of the window 63 are formed with arced pivot portions 65, respectively.

The lever 70 has a first rod 71 and a second rod 72 perpendicular to each other. The second rod 72 is pivotally connected to the first pivot portion 94 of the front end of the external metal seat 90. The middle segment of the second rod 72 is curved to form a convex rod 73. The external end of the first rod 71 is curved to form a handle 74. When the first rod 71 is rocked backwards, the convex rod 73 may press the tab 64 of the upper metal cover 60 so that the upper metal cover 60 presses the chip 37.

The rows of terminals 20 are respectively disposed in the rows of terminal slots 53 of the plastic base 50. Each row of terminals 20 is connected to a material tape 10. The one row of terminals 20 is assembled into the one row of terminal slots 53 and then separated from the material tape 10. The terminal 20 has an elastically moveable portion 21, a fixing portion 23 and a pin portion 24 from one end to the other end. The fixing portion 23 is wider than the elastically moveable portion 21 and the pin portion 24 so that it can be positioned with the first wall 54 of the terminal slot. The lower end of the fixing portion 23 is connected to the pin portion 24. The middle of the upper end of the fixing portion 23 is connected to the elastically moveable portion 21 and two sides of the upper end are formed with connection projections 217 connected to the material tape 10. The connection portion between the connection projection 217 and the material tape 10 is formed with a cut mark 25 through which the material tape 10 can be easily broken to separate the terminals 20 from the material tape 10. The elastically moveable portion 21 is a bent elastic arm. The elastically moveable portion 21 firstly extends to the second wall 55 and then turns to the fixing portion 23 and extends across the first wall 54 to be located above the front row of terminal slots 53. A connection point 28 is formed near a distal end of the elastically moveable portion 21. The connection point 28, is the highest point of the terminal and projects from the terminal slot 53 to the placement region 52. When the connection point 28 is forced, the elastically moveable portion 21 may elastically move up and down. The pin portion 24 extends from the channel 58 to the solder ball slot 56, and the pin portion 24 is bent and engages with one side of the solder ball 57.

The feature of this embodiment resides in that each row of terminals is one row of two same rows of terminals formed by oppositely tearing and pressing a metal sheet. The terminals of the two rows of terminals have oppositely torn and cut portions seamlessly oppositely connected together. When the one row of terminals is developed into a plane and one of the terminals is reverse-backside joined between the two neighboring terminals, the oppositely torn and cut portion of one of the terminals is seamlessly jointed to the oppositely torn and cut portions of the two neighboring terminals. The oppositely torn and cut portions of this embodiment are the fixing portion 23 and the pin portion 24.

The gap X between the pin portions of the neighboring terminals 20 is equal to the width Y of the fixing portion 23. The shape of the fixing portion 23 of the terminal may be reverse-backside joined to the gap region between the pin portions 24 of the two neighboring terminals and seamlessly connected to the pin portions 24 of the two neighboring terminals.

Figure 38:
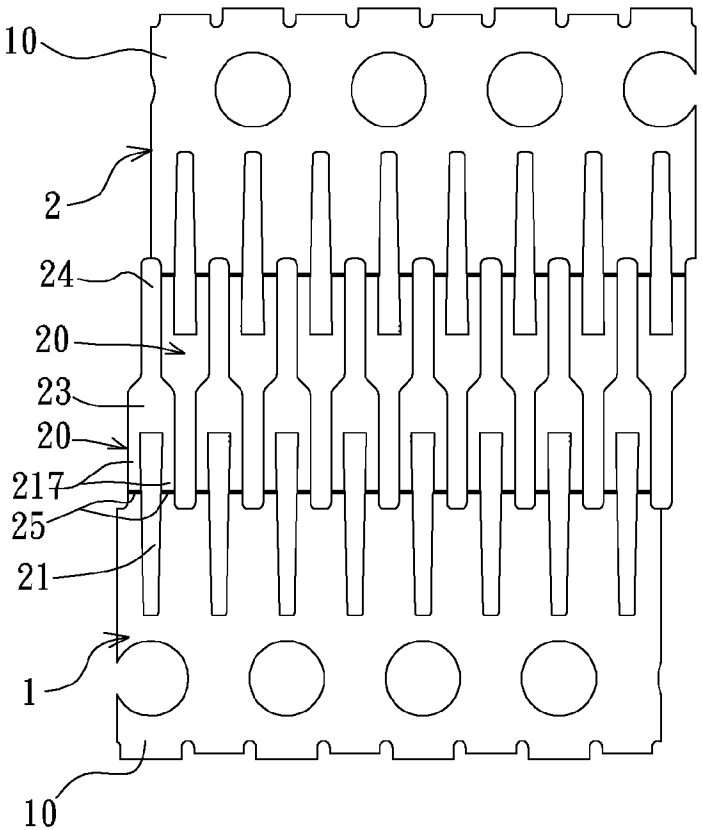
FIG. 38 is a developed plane view showing the two rows of terminals oppositely connected together according to the eleventh embodiment of the invention.
Figure 37:
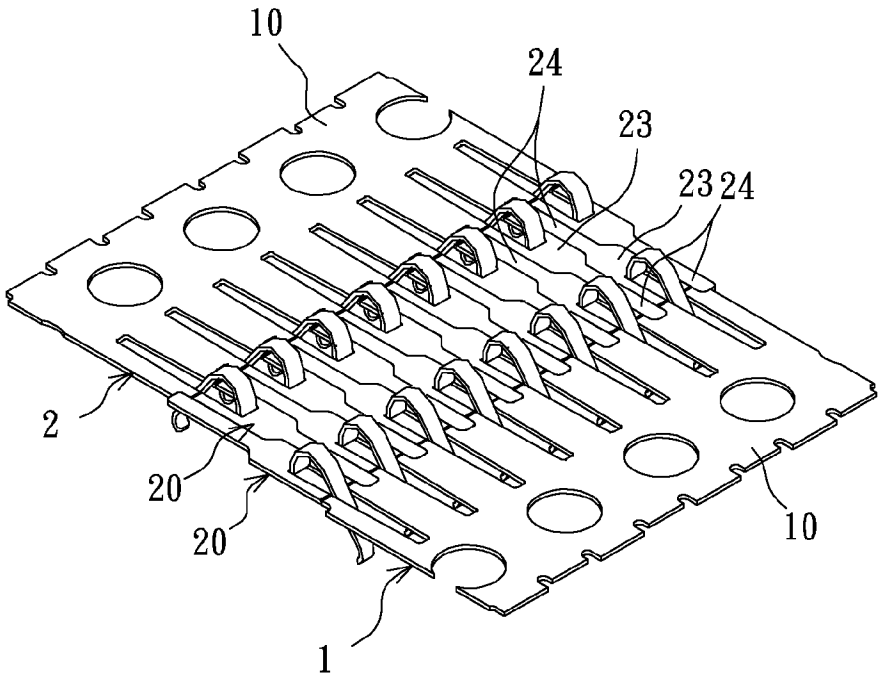
FIG. 37 is a pictorial view showing two rows of terminals oppositely connected together according to the eleventh embodiment of the invention.

According to the above-mentioned structure, the gap X between the pin portions of the neighboring terminals 20 is equal to the width Y of the fixing portion 23. As shown in FIGS. 37 and 38, two rows of separately arranged and oppositely connected terminals are formed by pressing the same metal sheet. That is, the fixing portion 23 of each terminal 20 of the first row 1 of terminals may be oppositely connected between the pin portions 24 of the neighboring terminals 20 of the second row 2 of terminals. Thus, the metal sheet can be pressed to form two rows of terminals so that no waste product except for the connected material tape is formed, the material may be significantly saved, and the manufacturing cost can be lowered.

Figure 39:
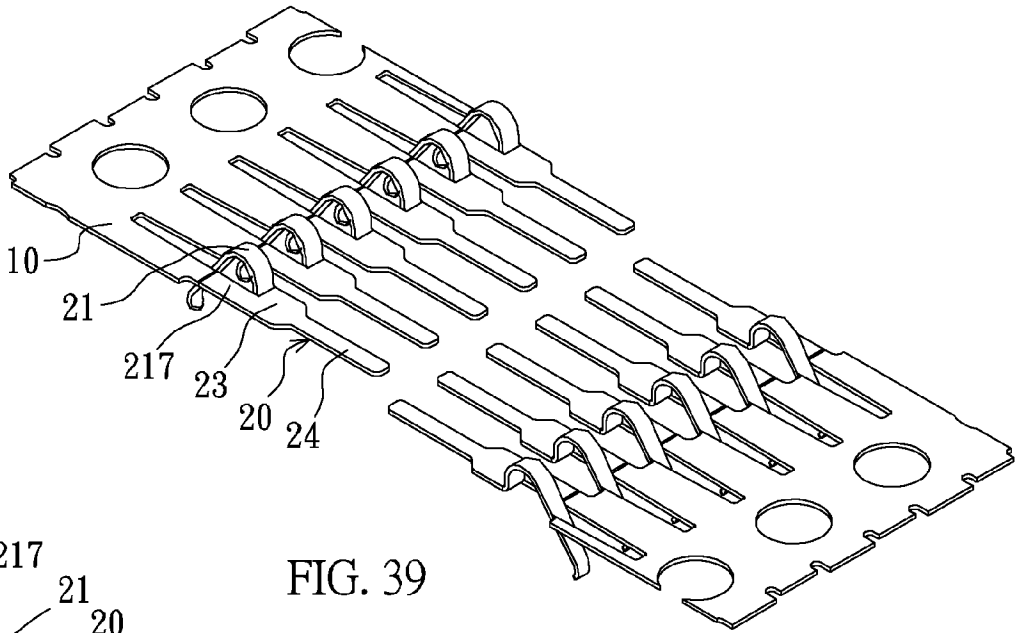
FIG. 39 is a pictorially exploded view showing two rows of terminals according to a twelfth embodiment of the invention.
Figure 40:
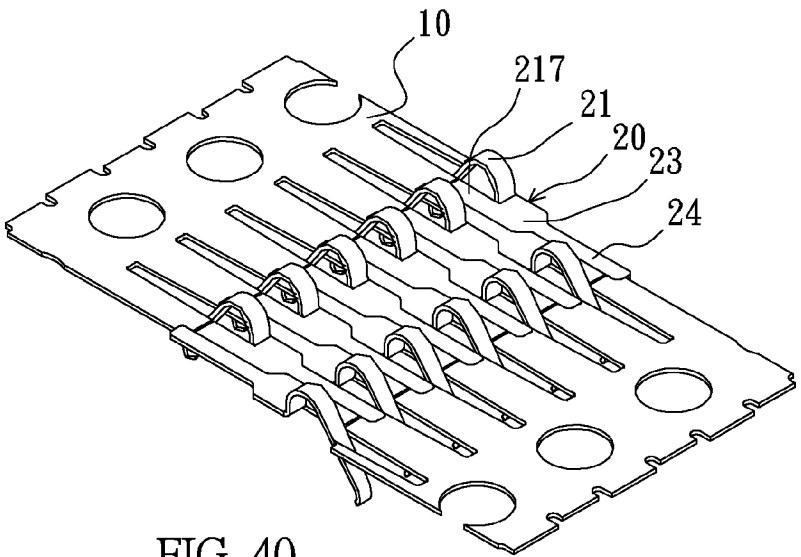
FIG. 40 is a pictorial view showing the two rows of terminals oppositely connected together according to the twelfth embodiment of the invention.

As shown in FIGS. 39 to 40, the twelfth embodiment of the invention is almost the same as the eleventh embodiment except that the elastically moveable portion 21 of the terminal 20 of this embodiment is connected to one side of the upper end of the fixing portion 23. The other side of the upper end of the fixing portion 23 is formed with a connection projection 217 connected to the material tape 10.

Figure 41:
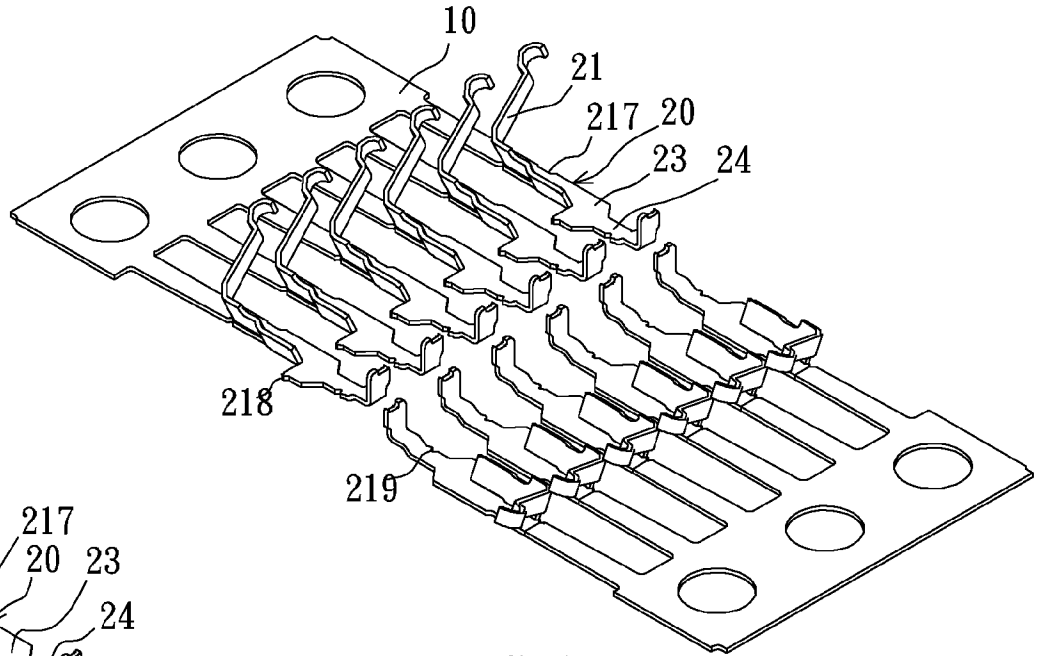
FIG. 41 is a pictorially exploded view showing two rows of terminals according to a thirteenth embodiment of the invention.
Figure 42:
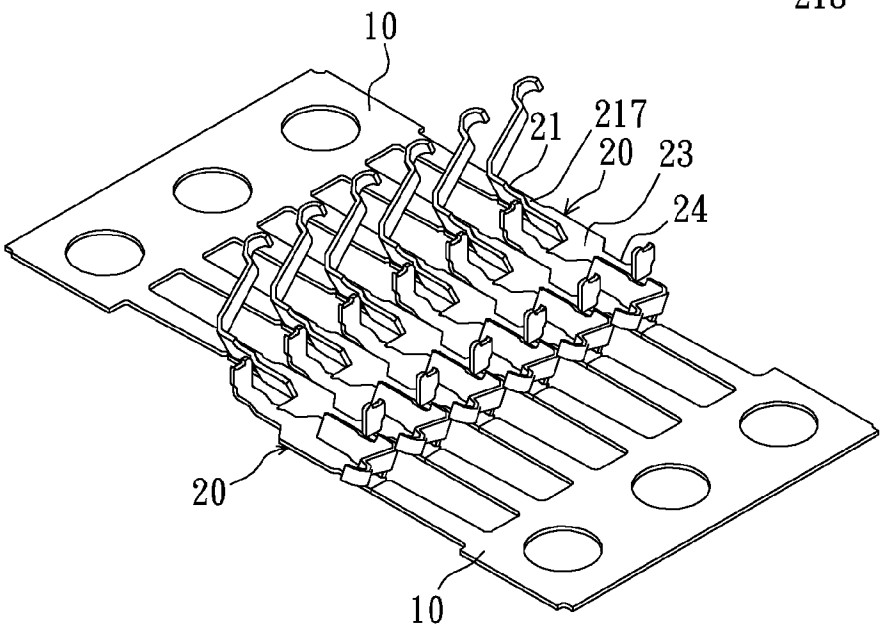
FIG. 42 is a pictorial view showing the two rows of terminals oppositely connected together according to the thirteenth embodiment of the invention.

As shown in FIGS. 41 and 42, the thirteenth embodiment of the invention is almost the same as the eleventh embodiment except that one side of the upper end of the fixing portion 23 of the terminal 20 of this embodiments is formed with a connection projection 217 connected to the material tape 10. The elastically moveable portion 21 is connected to one side of the connection projection 217 and turns an included angle of 90 degrees with respect to the connection projection 217. In addition, the fixing portion 23 of the terminal 20 is formed with the wider projecting barb 218, the pin portion 23 has a narrower concave portion 219, and the barb 218 may be seamlessly joined to the concave portion 219.

Figure 43:
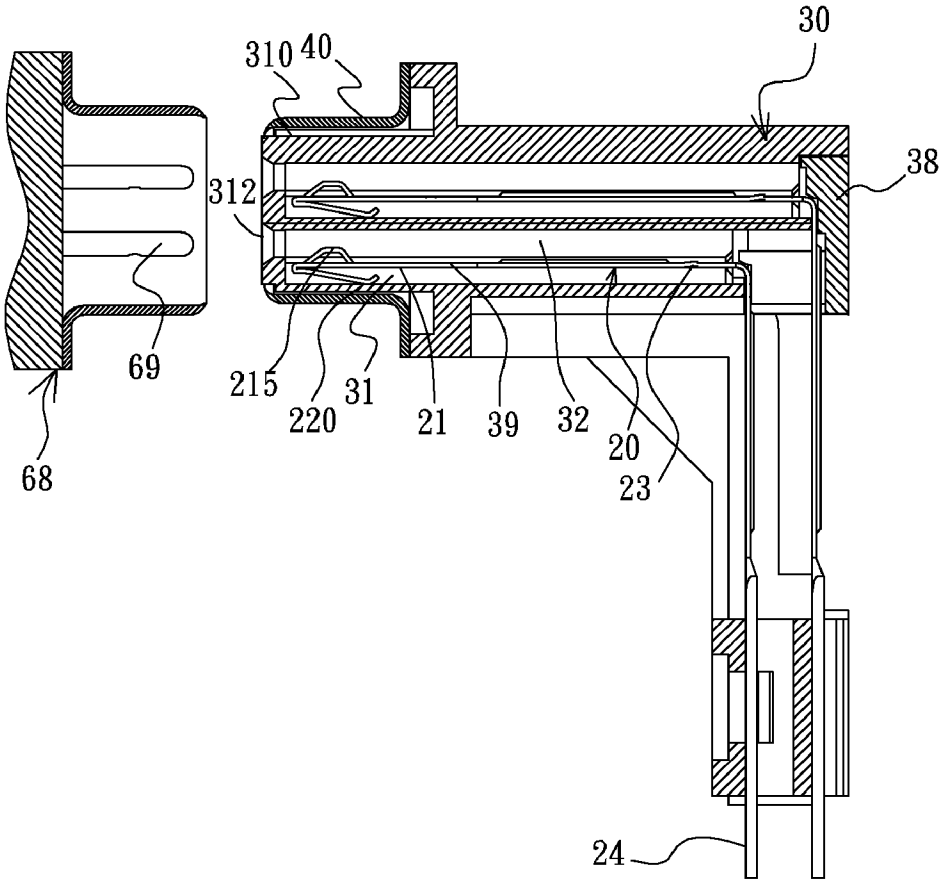
FIG. 43 is a cross-sectional side view showing a fourteenth embodiment of the invention.
Figure 44:
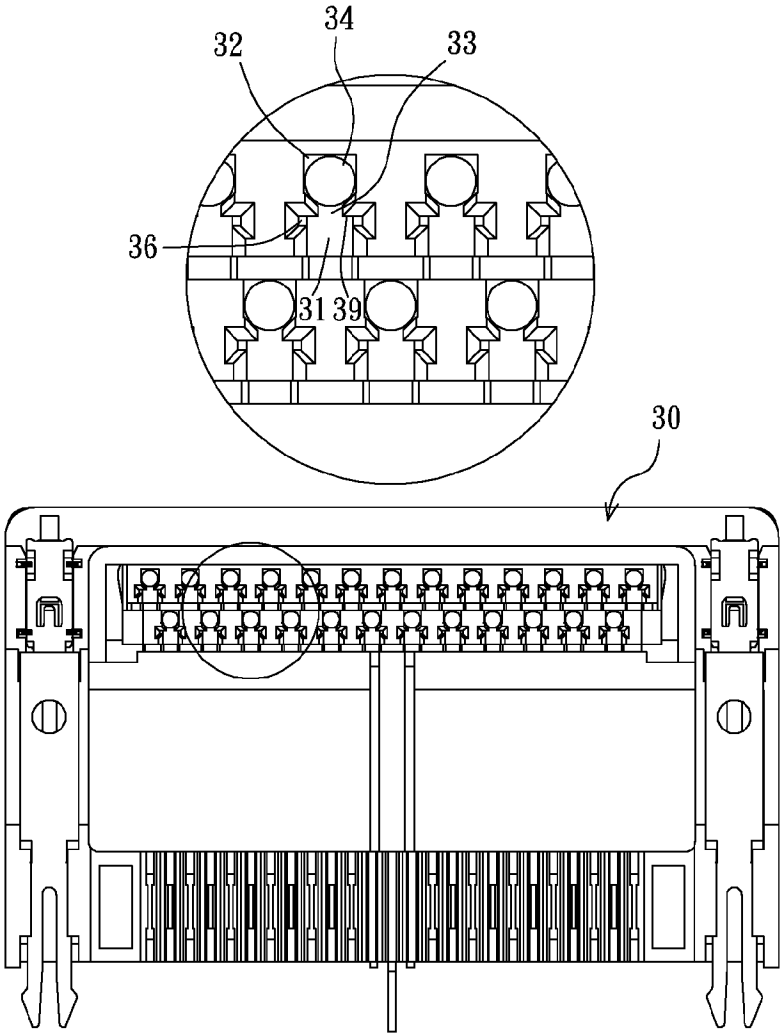
FIG. 44 is a rear view showing the plastic base according to the fourteenth embodiment of the invention.

As shown in FIGS. 43 and 44, the fourteenth embodiment of the invention is a D-SUB electrical connector and includes a plastic base 30, two rows of terminals 20 and a metal casing 40. The plastic base 30 has the elevated structure and is formed with terminal slots 31 and connection slots 32, which are arranged from top to bottom in two rows. The front end of the plastic base 30 has a projection 310. The front end of the projection 310 is formed with holes 312 corresponding to the connection slots 32, and formed with depressed engaging slots 36. The upper end of each terminal slot 31 is formed with the narrower opening 33 communicating with the connection slot 32 so that two sides of the opening are formed with resisting edge 39 and the depressed engaging slots 36. In addition, a rear cover 38 is provided to cover the back side of the plastic base 30.

The two rows of terminals 20 are correspondingly assembled into the two rows of terminal slots 31 of the plastic base. Each terminal 20 sequentially has an elastically moveable portion 21, a fixing portion 23 and a pin portion 24 from one end to the other end. The elastically moveable portion 21 is a single arm, has a horizontal plate surface and may elastically move. The plate surface near the distal end of the elastically moveable portion 21 is provided and pressed to form a narrower projecting connection point 215. The distal end of the elastically moveable portion 21 is reversely bent to form an auxiliary arm 220 projecting in a direction opposite the projecting direction of the connection point 215. The elastically moveable portion 21 elastically rests against the resisting edge 39. The connection point 215 projects into the connection slot 32. The auxiliary arm 220 rests against a wall surface of the terminal slot 31. The fixing portion 23 has a first end connected to the elastically moveable portion 21, and a second end connected to the pin portion 24.

The fixing portion 23 is engaged with the engaging slot 36. The fixing portion 23 is bent into two plate surfaces perpendicular to each other, wherein the longitudinal plate surface extends downward and is connected to the pin portion 24, and the plate surface of the pin portion 24 is bent so that its cross-section has an inverse-U shape and the pin portion 24 extends out of the plastic base.

The metal casing 40 is fit with the front end of the plastic base 30 and covers the periphery of the projection 310 to expose the hole 312 on the front surface of the projection.

Figure 45:
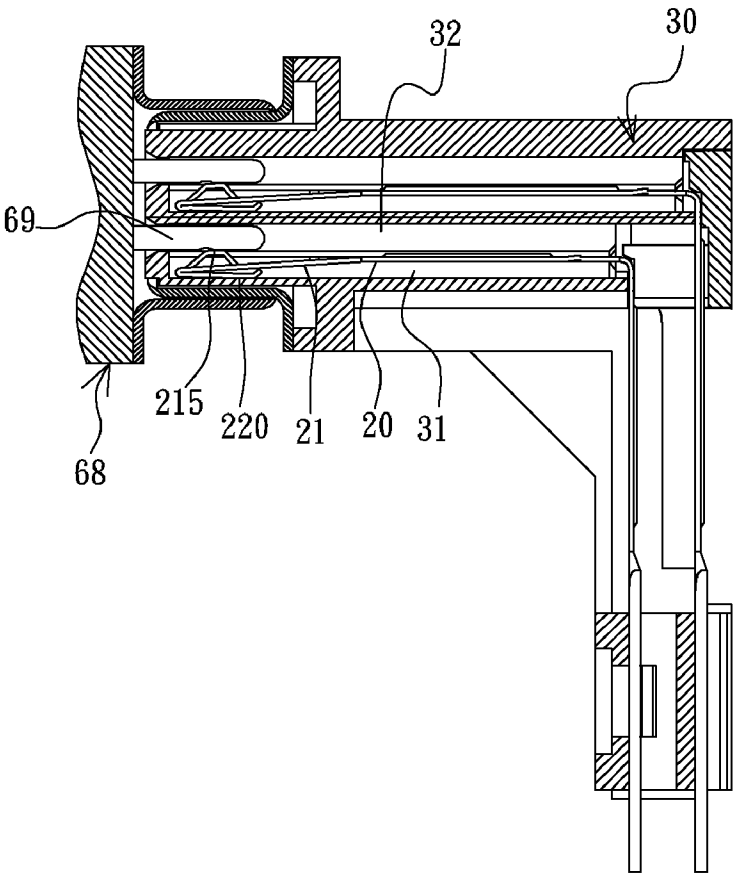
FIG. 45 shows the usage state of the fourteenth embodiment of the invention.

As shown in FIG. 45, when a male plug 68 is inserted, two rows of terminals 69 of the male plug 68 are inserted into the two rows of connection slots 32. The terminal 69 presses the connection point 215 so that the elastically moveable portion 21 elastically moves downwards while the auxiliary arm 220 is also compressed. Thus, the good elastic contact between the terminal 69 of the male plug 68 and the connection point 215 may be provided according to the elasticity of the elastically moveable portion 21 and the elasticity of the auxiliary arm 220

The feature of this embodiment resides in that each row of terminals 20 is one of two rows of same terminals formed by oppositely tearing and pressing a metal sheet. The terminals 20 of the two rows of terminals have oppositely torn and cut portions seamlessly oppositely connected together. When the one row of terminals 20 is developed into a plane and one of the terminals 20 is reverse-backside joined between two neighboring terminals, the oppositely torn and cut portion of the terminal is seamlessly jointed to the oppositely torn and cut portions of the two neighboring terminals. The oppositely torn and cut portion of this embodiment is the fixing portion 23. The gaps between the fixing portions 23 of the two neighboring terminals of the one row of terminals sequentially from the first ends to the second ends of the two neighboring terminals are equal to the widths of the fixing portion 23 of one of the terminals sequentially from the second end to the first end. The fixing portion 23 of this embodiment has the same width from the first end to the second end. When the one row of terminals 20 is developed into a plane and one of the terminal 20 is reverse-backside joined between the two neighboring terminals, the fixing portion 23 of the terminal is seamlessly jointed to the fixing portions 23 of the two neighboring terminals.

Figure 46:
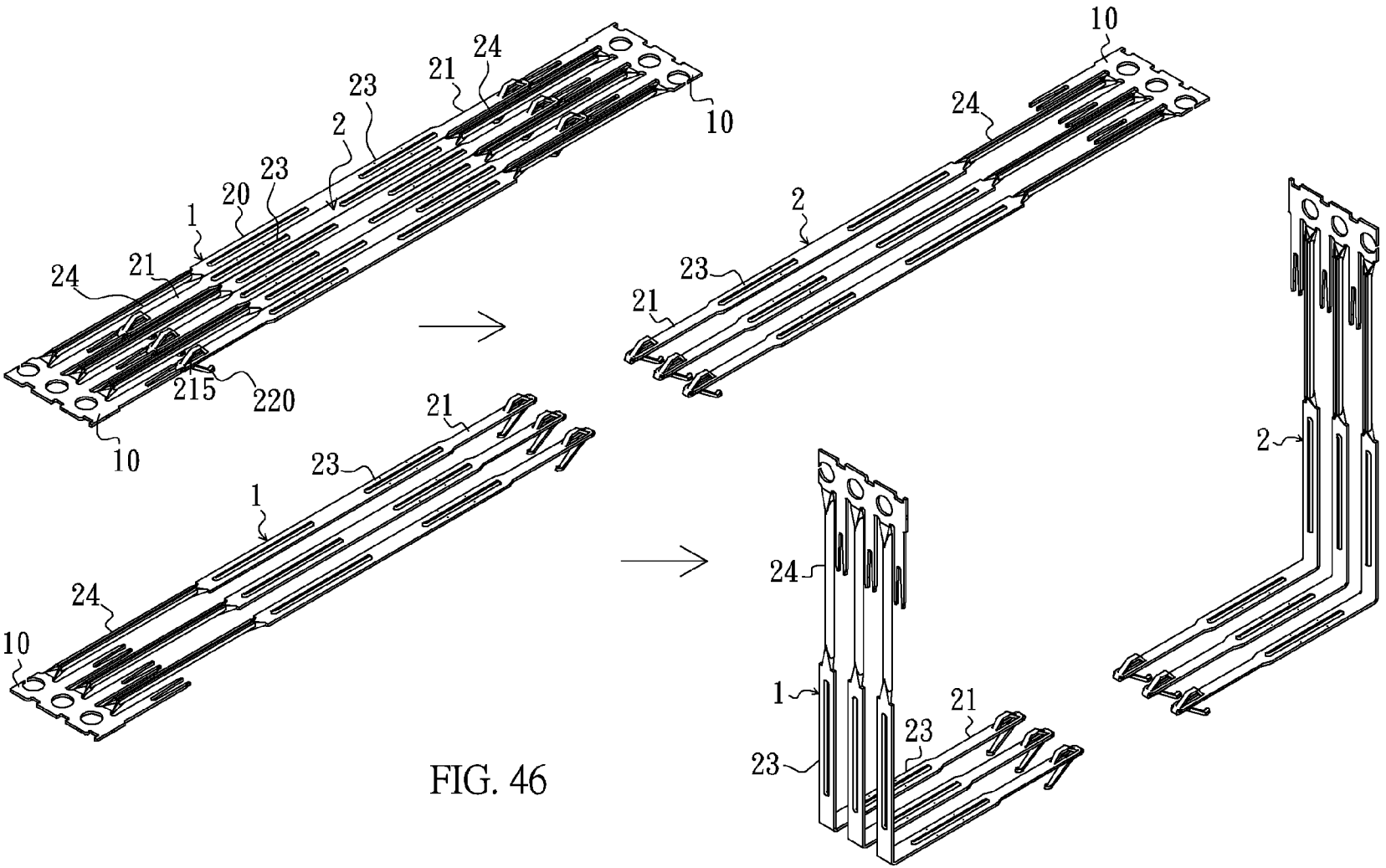
FIG. 46 is a schematic illustration showing the flow of manufacturing the terminals by way of pressing according to the fourteenth embodiment of the invention.

The row of terminals 20 of this embodiment is manufactured by way of pressing. As shown in FIG. 46, two rows of separately arranged and oppositely connected terminals are formed by pressing a metal sheet. Because the fixing portion 23 of each terminal 20 of the first row 1 of terminals is seamlessly oppositely connected between the fixing portions 23 of the two neighboring terminals 20 of the second row 2 of terminals, the metal sheet is firstly oppositely torn into first and second rows 1 and 2 of terminals, which are then separated and bent to form the fixing portions 23.

Figure 47:
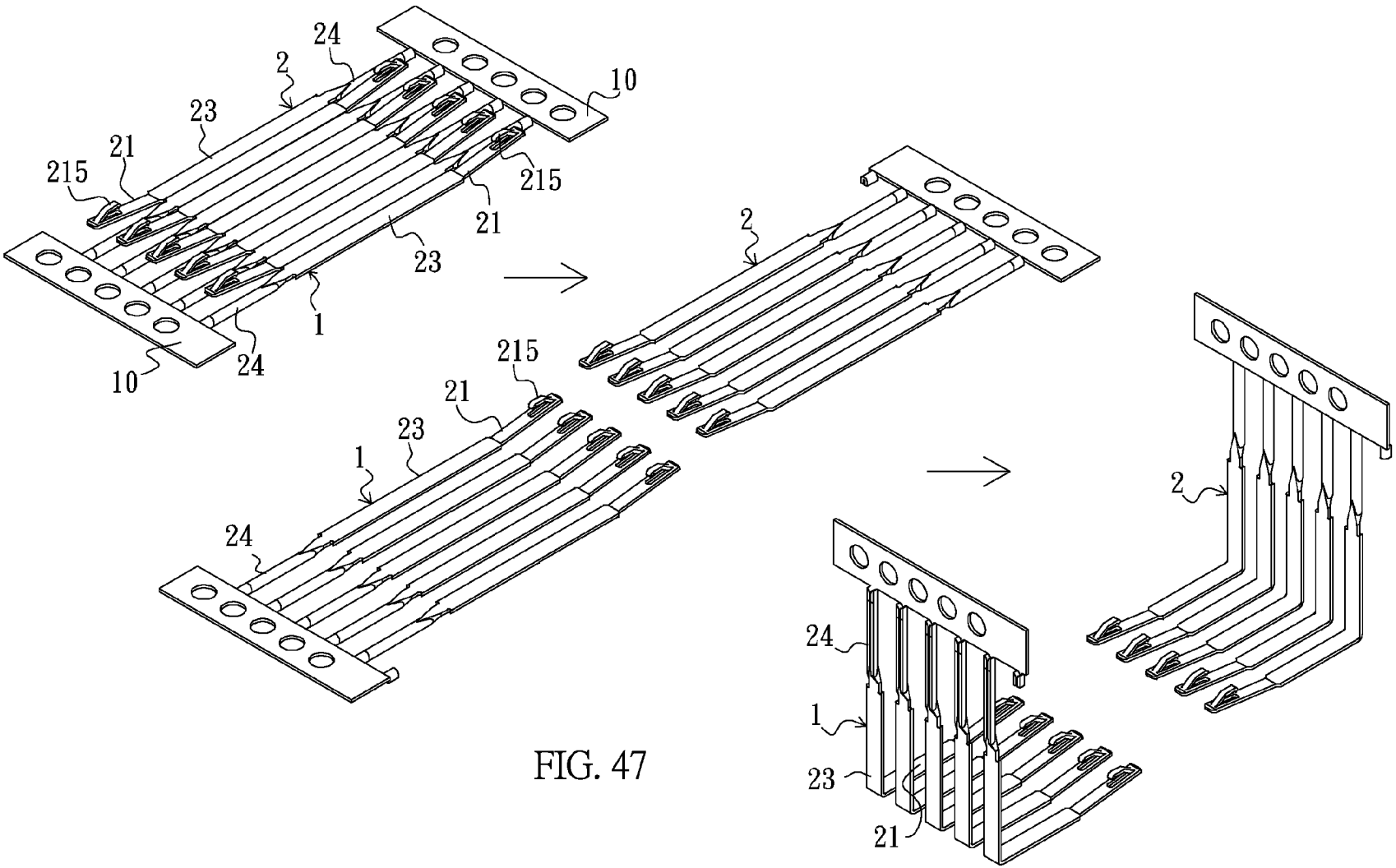
FIG. 47 is a schematic illustration showing the flow of manufacturing the terminals by way of pressing according to a fifteenth embodiment of the invention.

As shown in FIG. 47, the fifteenth embodiment the invention is almost the same as the fourteenth embodiment except that the plastic base of this embodiment is lower than the fourteenth embodiment. So, the fixing portion 23 and the pin portion 24 become shorter. The oppositely torn and cut portion of this embodiment is also the fixing portion 23. The fixing portion 23 has the uniform width. When the one row of terminals 20 is developed into a plane and one of the terminals 20 is reverse-backside joined between the two neighboring terminals, the fixing portion 23 of the terminal is seamlessly jointed to the fixing portions 23 of the two neighboring terminals. Two rows of separately arranged and oppositely connected terminals 20 are formed by pressing the same metal sheet. Because the fixing portion 23 of each terminal 20 of the first row 1 of terminals is oppositely connected between the fixing portions 23 of the two neighboring terminals 20 of the second row 2 of terminals, the metal sheet is firstly oppositely torn into first and second rows 1 and 2 of terminals, which are then separated and bent to form the fixing portions 23.

Figure 48:
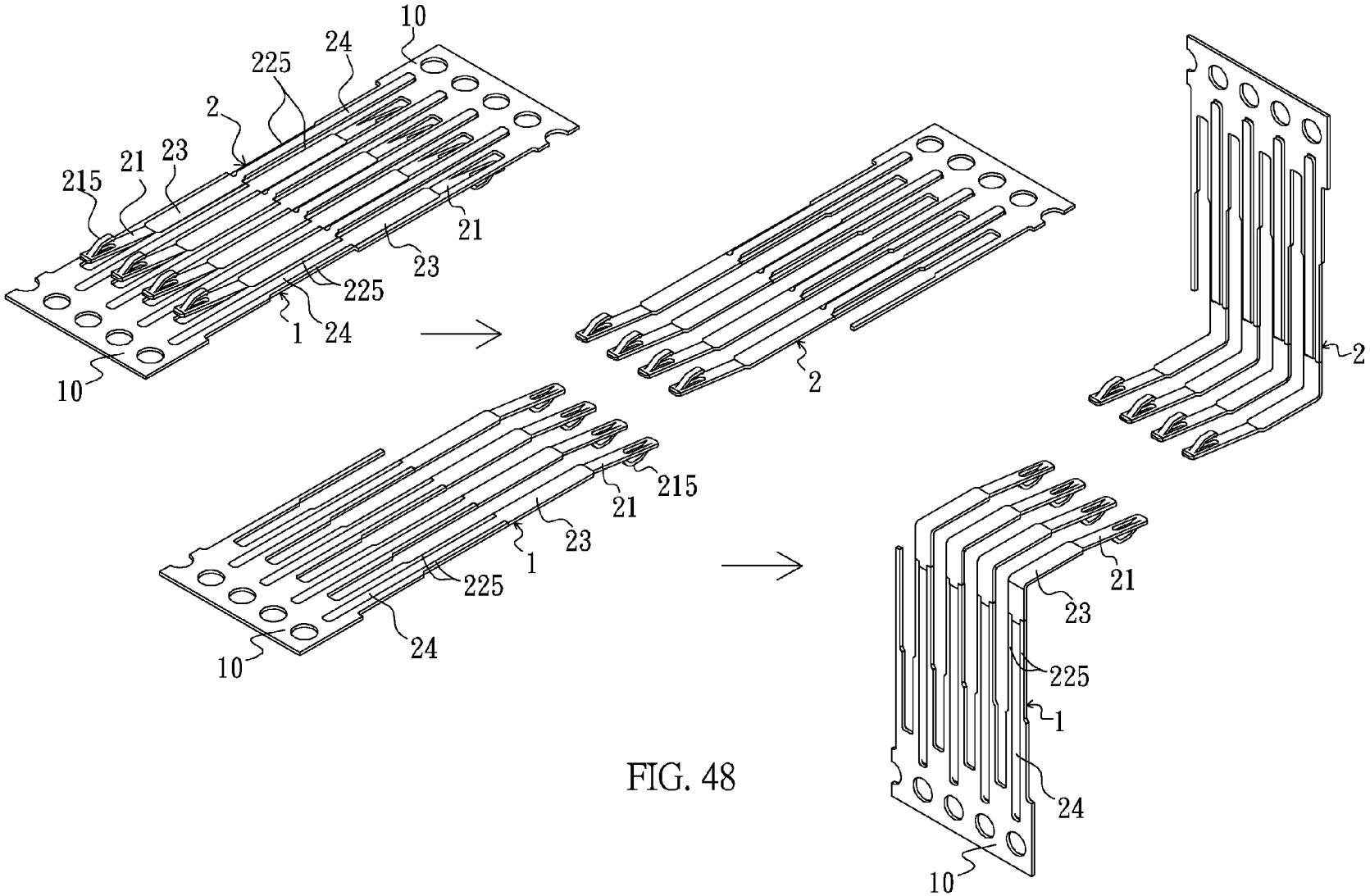
FIG. 48 is a schematic illustration showing the flow of manufacturing the terminals by way of pressing according to a sixteenth embodiment of the invention.

As shown in FIG. 48, the sixteenth embodiment of the invention is almost the same as the fifteenth embodiment. The one row of terminals 20 of this embodiment is connected to a material tape 10 and is one of two rows of same terminals formed by oppositely tearing and pressing the metal sheet. Each terminal 20 has an elastically moveable portion 21, a fixing portion 23 and a pin portion 24 from one end to the other end. The plate surface of the elastically moveable portion 21 is pressed to form a projecting connection point 215. Two sides of the pin portion 24 are seamlessly jointed to two connection sheets 225, respectively. Each connection sheet 225 has one end connected to the material tape, and the other end connected to the other end of the fixing portion 23 with a folding mark to facilitate the breaking.

Similarly, the feature of this embodiment resides in that each row of terminals 20 is one row of two same rows of terminals formed by oppositely tearing and pressing a metal sheet. The terminals 20 of the two rows of terminals have oppositely torn and cut portions seamlessly oppositely connected together. When the one row of terminals 20 is developed into a plane and one of the terminals 20 is reverse-backside joined between the two neighboring terminals, the oppositely torn and cut portion of the terminal is seamlessly jointed to the oppositely torn and cut portion of the two neighboring terminals. The oppositely torn and cut portion of this embodiment is the elastically moveable portion 21, the fixing portion 23 and the connection sheets 225 on two sides of the pin portion 24. When the one row of terminals 20 is developed into a plane and one of the terminals 20 is reverse-backside joined between the two neighboring terminals, the elastically moveable portion 21 and the fixing portion 23 of the terminal are seamlessly jointed to the connection sheets 225 on two sides of the pin portions 24 of the two neighboring terminals.

Two rows of separately arranged and oppositely connected terminals 20 of this embodiment are formed by pressing one metal sheet. Because the elastically moveable portion 21 and the fixing portion 23 of each terminal 20 of the first row 1 of terminals are seamlessly oppositely connected to the connection sheets 225 on two sides of the pin portions 24 of the two neighboring terminals 20 of the second row 2 of terminals, the metal sheet is firstly oppositely torn into first and second rows 1 and 2 of terminals, which are then separated and bent to form the fixing portions 23.

Figure 50:
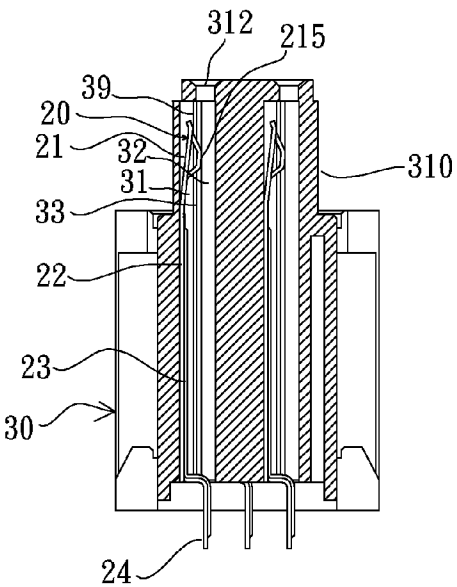
FIG. 50 is a cross-sectional side view showing the seventeenth embodiment of the invention.
Figure 49:
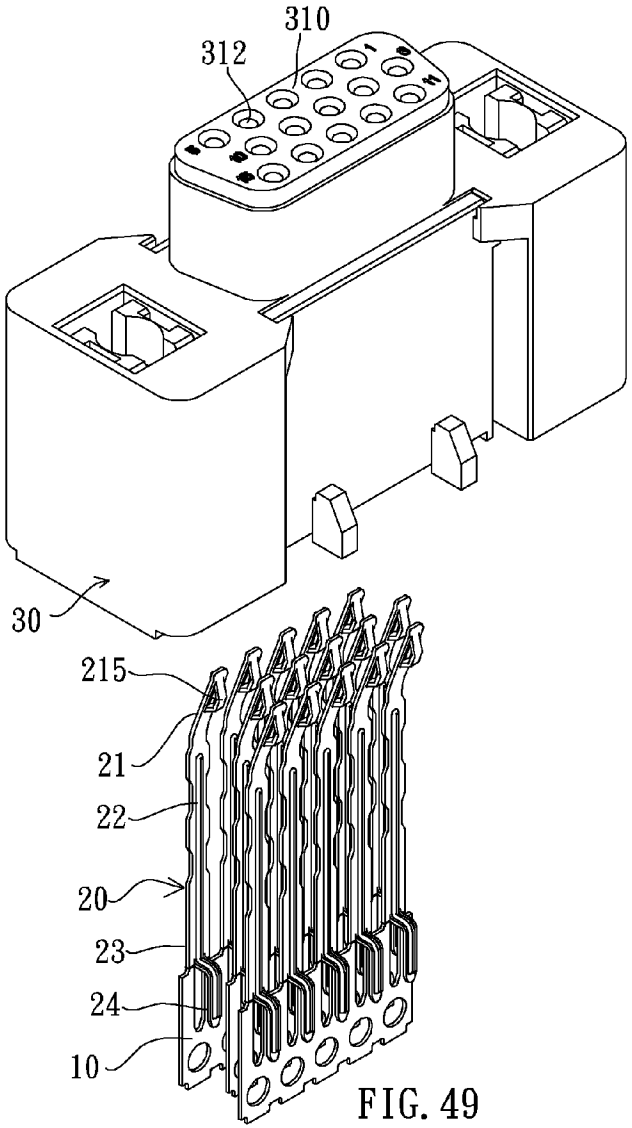
FIG. 49 is a pictorially exploded view showing a seventeenth embodiment of the invention.

As shown in FIGS. 49 and 50, the seventeenth embodiment of the invention is an upright D-SUB electrical connector an includes a plastic base 30, three rows of terminals 20 and a metal casing 40.

The upright plastic base 30 is formed with multiple terminal slots 31 and multiple connection slots 32, which are arranged in three rows. The upper end of the plastic base 30 is formed with a projection 310. The front end of the projection 310 has many holes 312 corresponding to the connection slots 32. Similar to the fourteenth embodiment, each terminal slot 31 is formed with a narrower opening 33 communicating with the connection slot 32. Two sides of the opening are formed with resisting edges 39.

The three rows of terminals 20 are correspondingly assembled into the three rows of terminal slots 31 of the plastic base. Each of the terminals 20 sequentially has an elastically moveable portion 21, an extension 22, a fixing portion 23 and a pin portion 24 from one end to the other end. The elastically moveable portion 21 is a single arm, which has a longitudinal plate surface and may move elastically. The plate surface near the distal end of the elastically moveable portion 21 is prodded and pressed to form a narrower projecting connection point 215. The elastically moveable portion 21 elastically rests against the resisting edge 39. The connection point 215 projects to the connection slot 32. The fixing portion 23 and the extension 22 are engaged with the terminal slot 31, and the pin portion 24 extends out of the plastic base 30.

The metal casing 40 is fit with the front end of the plastic base 30 and covers the periphery of the projection 310 to expose the hole 312 on the projection.

Figure 51:
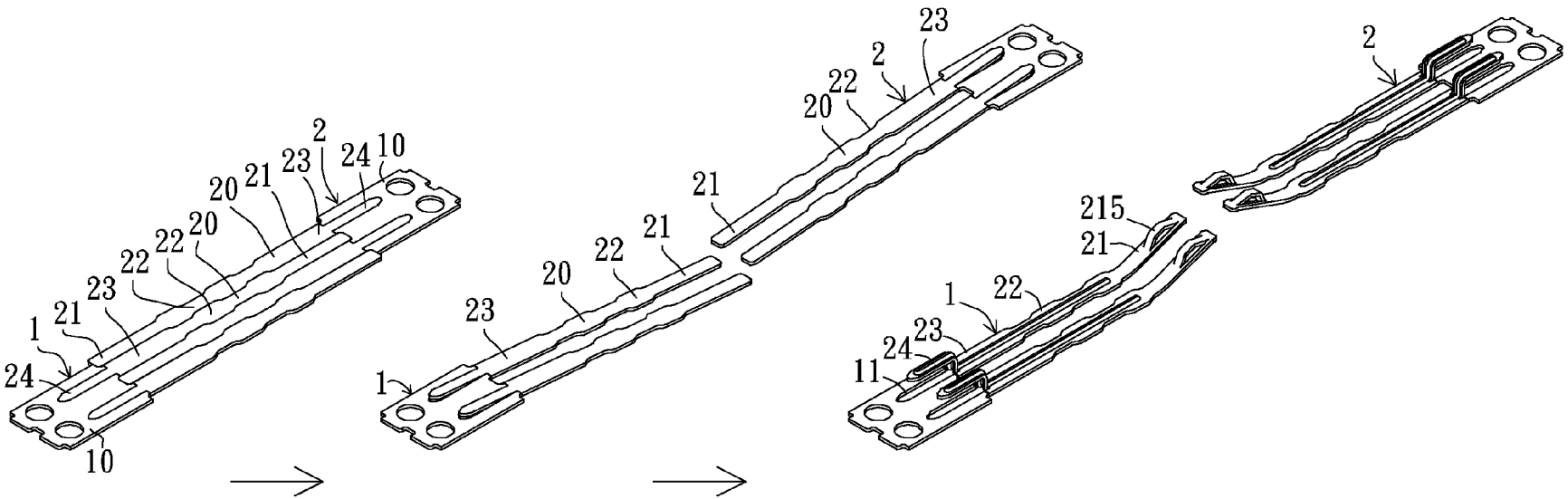
FIG. 51 is a schematic illustration showing the flow of manufacturing the terminals by way of pressing according to the seventeenth embodiment of the invention.

As shown in FIG. 51, one row of terminals of this embodiment is one of two rows of same terminals formed by oppositely tearing and pressing a metal sheet and includes a material tape 10 and multiple terminals 20.

The material tape 10 is formed with many separately arranged long holes 11.

The terminals 20 are separated arranged and connected to the material tape 10. The elastically moveable portion 21 has first and second ends, the extension 22 has first and second ends and the fixing portion 23 has first and second ends. The first end of the elastically moveable portion 21 is the tail end of the terminal. The second end of the elastically moveable portion 21 is connected to the first end of the extension 22. The second end of the extension 22 is connected to the first end of the fixing portion 23. The second end of the fixing portion 23 is connected to the pin portion 24 and the material tape 10. The width of the fixing portion 23 is greater than the width of the elastically moveable portion 21. Each of the elastically moveable portion 21 and the fixing portion 23 of the terminal of this embodiment has the uniform width from the first end to the second end thereof. The extension 22 has a convex-concave shape from the first end to the second end.

The structure of the terminal 20 of this embodiment is almost the same as that of the first embodiment. Similarly, the gaps between the elastically moveable portions 21 of the two neighboring terminals sequentially from the first ends to the second ends of the elastically moveable portions 21 are equal to the widths of the fixing portion 23 sequentially from the second end to the first end of the fixing portion 23. Also, the gaps between the extensions of the two neighboring terminals sequentially from the first ends to the second ends of the extensions are equal to the widths of the extension sequentially from the second end to the first end of the extension. When the one row of terminals is developed into a plane, the shape of the fixing portion 23 may be reverse-backside seamlessly jointed to the gap region between the elastically moveable portions 21 of the two neighboring terminals. The shape of the extension 22 may be reversely seamlessly jointed to the gap region between the extensions 22 of the two neighboring terminals.

According to the above-mentioned structure, two rows of separately arranged and oppositely connected terminals may be formed by pressing one metal sheet. The extension 22 and the fixing portion 23 of each terminal 20 of the first row 1 of terminals are respectively seamlessly oppositely connected between the extensions 22 and the elastically moveable portions 21 of the two neighboring terminals 20 of the second row 2 of terminals. So, the metal sheet is firstly oppositely torn into first and second rows 1 and 2 of terminals, which are then separated and bent to form the elastically moveable portion 21.

Figure 52:
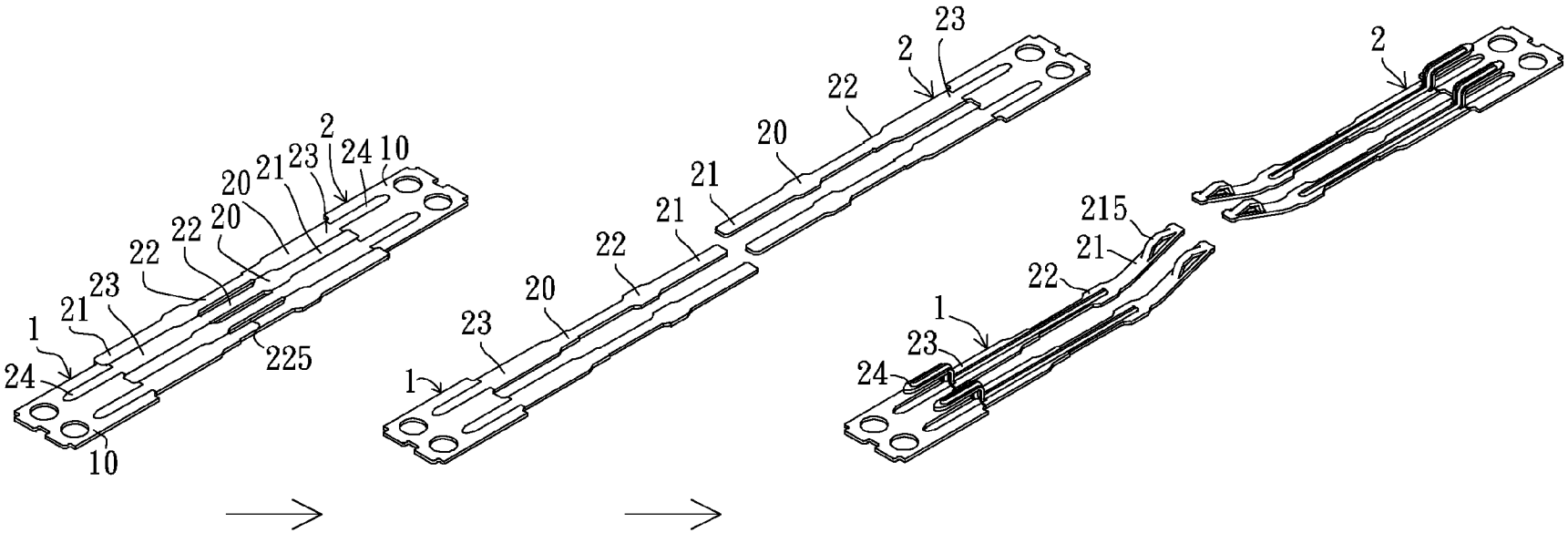
FIG. 52 is a schematic illustration showing the now of manufacturing the terminals by way of pressing according to an eighteenth embodiment of the invention.

As shown in FIG. 52, the structure of the terminal 20 of the eighteenth embodiment of the invention is almost the same as that of the seventeenth embodiment except that some gaps 226 are formed when the extension 22 of the terminal 20 of the first row 1 of terminals of this embodiment is oppositely connected the extension 22 of the terminal 20 of the second row 2 of terminals.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. An electrical connector, comprising:

a plastic base having at least one row of terminal slots; and at least one row of terminals disposed in the at least one row of terminal slots of the plastic base, wherein each of the terminals has an elastically moveable portion, a fixing portion and a pin portion from one end to the other end, the elastically moveable portion has a connection point, the fixing portion is fixed into the terminal slot, the pin portion extends out of the plastic base, and an inserted electrical element may be connected to the connection point and elastically move the elastically moveable portion;

wherein the at least one row of terminals is one row of two rows of terminals formed by oppositely tearing and pressing a metal sheet, each of the terminals of the two rows of terminals has an oppositely torn and cut portion, the oppositely torn and cut portions are seamlessly oppositely connected together, and when the one row of terminals is developed into a plane and one of the terminals is reverse-backside joined between the two neighboring terminals of the terminals, the oppositely torn and cut portion of the terminal is seamlessly jointed to the oppositely torn and cut portions of the two neighboring terminals.

2. The electrical connector according to claim 1, wherein the oppositely torn and cut portion of each of the at least one row of terminals comprises the elastically moveable portion and the fixing portion, an extension is disposed between the elastically moveable portion and the fixing portion, a width of the fixing portion is greater than a width of the extension and a width of the elastically moveable portion, the elastically moveable portion has first and second ends, the extension has first and second ends, the fixing portion has first and second ends, the first end of the elastically moveable portion is a tail end of the terminal, the second end of the elastically moveable portion is connected to the first end of the extension, the second end of the extension is connected to the first end of the fixing portion, and the second end of the fixing portion is connected to the pin portion, wherein gaps between the elastically moveable portions of the two neighboring terminals sequentially from the first ends to the second ends of the elastically moveable portions are equal to widths of the fixing portion sequentially from the second end to the first end of the fixing portion, and when the one row of terminals is developed into the plane, a shape of the fixing portion of one of the terminals may be reverse-backside joined to a gap region between the elastically moveable portions of the two neighboring terminals.

3. The electrical connector according to claim 2, wherein the oppositely torn and cut portion further comprises the extension, gaps between the extensions of the two neighboring terminals sequentially from the first ends to the second ends of the extensions are equal to the widths of the extension sequentially from the second end to the first end of the extension, the width of the extension is greater than the width of the elastically moveable portion, and when the one row of terminals is developed into the plane, a shape of the extension can reverse-backside seamlessly jointed to a gap region between the extensions of the two neighboring terminals.

4. The electrical connector according to claim 3, wherein the extension has a first extension segment and a second extension segment having the same length, a width of the second extension segment is greater than a width of the first extension segment, a gap between the first extension segments of the two neighboring terminals is equal to the width of the second extension segment, and the width of the first extension segment plus the width of the second extension segment is equal to the width of the elastically moveable portion plus the width of the fixing portion.

5. The electrical connector according to claim 3, wherein the extension of each of the terminals has a convex-concave shape from the first end to the second end.

6. The electrical connector according to claim 2, wherein the fixing portion has a first fixing portion segment and a second fixing portion segment having different widths, a width of the second fixing portion segment is greater than a width of the first fixing portion segment, the elastically moveable portion has a first elastically moveable portion segment and a second elastically moveable portion segment having different widths, a width of the second elastically moveable portion segment is greater than a width of the first elastically moveable portion segment, a length of the second elastically moveable portion segment is the same as a length of the first fixing portion segment, a gap between the first elastically moveable portion segments of the two neighboring terminals is equal to the width of the second fixing portion segment, a gap between the second elastically moveable portion segments of the two neighboring terminals is equal to the width of the first fixing portion segment, and the width of the first elastically moveable portion segment plus the width of the second fixing portion segment is equal to the width of the second elastically moveable portion segment plus the width of the first fixing portion segment.

7. The electrical connector according to claim 2, wherein the fixing portion has a barb with a greater width, the elastically moveable portion has a concave portion with a smaller width, and the barb may be seamlessly connected to the concave portion.

8. The electrical connector according to claim 2, wherein when the one row of terminals is developed into the plane, the shape of the fixing portion of one of the terminals is reverse-backside joined to the gap region between the elastically moveable portions of the two neighboring terminals to seamlessly rest against the elastically moveable portions of the two neighboring terminals.

9. The electrical connector according to claim 1, wherein the plastic base has a connection slot, the terminal slot has a resting surface at an insert port of the connection slot, and the elastically moveable portion of the terminal elastically rests against the resting surface.

10. The electrical connector according to claim 1, wherein the plastic base have two rows of terminal slots separated by a gap and facing each other, a connection slot is formed between the two rows of the terminal slots, the plastic base is longitudinal, the connection slot is also longitudinal, the two rows of terminal slots extend in a vertical direction, and the elastically moveable portion of the terminal may move laterally.

11. The electrical connector according to claim 1, wherein there are two rows of terminal slots separated by a gap and facing each other, a connection slot is formed between the two rows of terminal slots, the two rows of terminal slots extend in a back-and-forth direction, and the elastically moveable portion of the terminal may elastically move up and down.

12. The electrical connector according to claim 11, further comprising a metal casing covering the plastic base.

13. The electrical connector according to claim 1, wherein the at least one row of terminal slots extends in a back-and-forth direction, and the electrical connector further comprises an upper metal cover covering over the plastic base.

14. The electrical connector according to claim 1, wherein the oppositely torn and cut portions of the at least one row of terminals are elastically moveable portions, the width of the fixing portion is greater than the width of the elastically moveable portion, the elastically moveable portion has first and second ends, the first end of the elastically moveable portion is a tail end of the terminal, and the second end of the elastically moveable portion is connected to the fixing portion, wherein gaps between the elastically moveable portions sequentially from the first ends to the second ends of the two neighboring terminals are equal to widths of the elastically moveable portion sequentially from the second end to the first end of the elastically moveable portion, and when the one row of terminals is developed into the plane, a shape of the elastically moveable portion of one of the terminals can be reverse-backside joined to a gap region between the elastically moveable portions of the two neighboring terminals.

15. The electrical connector according to claim 14, wherein when the one row of terminals is developed into the plane, the shape of the elastically moveable portion of one of the terminals is reverse-backside seamlessly jointed to the gap region between the elastically moveable portions of the two neighboring terminals.

16. The electrical connector according to claim 1, wherein when the one row of terminals is developed into the plane and one of the terminals is reverse-backside joined between the two neighboring terminals, a cut surface of the oppositely torn and cut portion of one of the terminals is seamlessly jointed to cut surfaces of the oppositely torn and cut portions of the two neighboring terminals.

17. The electrical connector according to claim 1, wherein the plastic base has multiple rows of terminal slots separately arranged, the terminal slot has a first wall and a second wall for separating the terminal slot from the front and rear rows of terminal slots, the oppositely torn and cut portions of the at least one row of terminals comprise the pin portions and the fixing portions, a gap between pin portions of the same row of neighboring terminals is equal to a width of the fixing portion, and a shape of the fixing portion of one of the terminals may be reverse-backside joined to a gap region between the pin portions of the two neighboring terminals.

18. The electrical connector according to claim 17, wherein the shape of the fixing portion of one of the terminals of the one row of terminals may be reverse-backside seamlessly jointed to the gap region between the pin portions of the two neighboring terminals.

19. The electrical connector according to claim 17, wherein the connection point, which is the highest point of the terminal, is formed near a distal end of the elastically moveable portion of the terminal, the elastically moveable portion may elastically move up and down when the connection point is forced, and the elastically moveable portion of the terminal extends across the first wall to be located above the front row of terminal slots.

20. The electrical connector according to claim 17, wherein the elastically moveable portion of the terminal is connected to a middle of an upper end of the fixing portion, and two sides of the upper end of the fixing portion are respectively formed with two connection projections.

21. The electrical connector according to claim 17, wherein one side of an upper end of the fixing portion of the terminal is formed with a connection projection, and the elastically moveable portion is connected to one side of the connection projection and turns an included angle.

22. The electrical connector according to claim 1, wherein the two rows of terminals formed by oppositely tearing and pressing the metal sheet have the same structure.

23. The electrical connector according to claim 1, wherein the oppositely torn and cut portions of the at least one row of terminals comprise the fixing portions, each having a first end connected to the elastically moveable portion and a second end connected to the pin portion, wherein gaps between the fixing portions of the two neighboring terminals of the one row of terminals sequentially from the first ends to the second ends of the fixing portions are equal to widths of the fixing portion of one of the terminals sequentially from the second end to the first end of the fixing portion, and when the one row of terminals is developed into the plane and one of the terminals is reverse-backside joined between the two neighboring terminals, the fixing portion of the terminal is seamlessly jointed to the fixing portions of the two neighboring terminals.

24. The electrical connector according to claim 23, wherein the plastic base further has at least one row of connection slots each communicating with a connection slot, one end of the plastic base is formed with a projection, the projection is formed with at least one row of holes corresponding to the at least one row of connection slots, the electrical connector further comprises a metal casing covering the one end of the plastic base and a periphery of the projection to expose the holes of the projection.

25. The electrical connector according to claim 23, wherein the fixing portion has an equal width from the first end to the second end, the fixing portion is bent into two plate surfaces perpendicular to each other, and a longitudinal plate surface of the plate surfaces extends downward and is connected to the pin portion.

26. The electrical connector according to claim 24, wherein the elastically moveable portions, the fixing portions and the pin portions of the at least one row of terminals extend longitudinally, and the projection of the plastic base faces upward.

27. A structure of one row of terminals being one row of terminals of two rows of terminals formed by oppositely tearing and pressing a metal sheet, the structure of the one row of terminals comprising:

a material tape; and a plurality of terminals separately arranged and connected to the material tape, wherein each of the terminals has an elastically moveable portion, a fixing portion and a pin portion from one end to the other end, a width of the fixing portion is greater than a width of the elastically moveable portion, and the elastically moveable portion has a connection point that can elastically move;

wherein the at least one row of terminals is one row of two rows of terminals formed by oppositely tearing and pressing the metal sheet, each of the terminals of the two rows of terminals has an oppositely torn and cut portion, the oppositely torn and cut portion are seamlessly oppositely connected together, and when the one row of terminals is developed into a plane and one of the terminals is reverse-backside joined between two neighboring terminals of the terminals, the oppositely torn and cut portion of the terminal is seamlessly jointed to the oppositely torn and cut portions of the two neighboring terminals.

28. The structure according to claim 27, wherein the oppositely torn and cut portion of each of the terminals comprises the elastically moveable portion and the fixing portion, an extension is disposed between the elastically moveable portion and the fixing portion, the width of the fixing portion is greater than a width of the extension and the width of the elastically moveable portion, the elastically moveable portion has first and second ends, the extension has first and second ends, the fixing portion has first and second ends, the first end of the elastically moveable portion is a tail end of the terminal, the second end of the elastically moveable portion is connected to the first end of the extension, the second end of the extension is connected to the first end of the fixing portion, and the second end of the fixing portion is connected to the pin portion, wherein gaps between the elastically moveable portions of the two neighboring terminals sequentially from the first ends to the second ends of the elastically moveable portions are equal to widths of the fixing portion sequentially from the second end to the first end of the fixing portion, and when the one row of terminals is developed into the plane, a shape of the fixing portion of one of the terminals may be reverse-backside joined to a gap region between the elastically moveable portions of the two neighboring terminals.

29. The structure according to claim 28, wherein the oppositely torn and cut portion further comprises the extension, gaps between the extensions of the two neighboring terminals sequentially from the first ends to the second ends of the extensions are equal to the widths of the extension sequentially from the second end to the first end of the extension, the width of the extension is greater than the width of the elastically moveable portion, and when the one row of terminals is developed into the plane, a shape of the extension can reverse-backside seamlessly jointed to a gap region between the extensions of the two neighboring terminals.

30. The structure according to claim 28, wherein the fixing portion has a first fixing portion segment and a second fixing portion segment having different widths, the width of the second fixing portion segment is greater than the width of the first fixing portion segment, the elastically moveable portion has a first elastically moveable portion segment and a second elastically moveable portion segment having different widths, the width of the second elastically moveable portion segment is greater than the width of the first elastically moveable portion segment, a gap between the first elastically moveable portion segments of the two neighboring terminals is equal to the width of the second fixing portion segment, a gap between the second elastically moveable portion segments of the two neighboring terminals is equal to the width of the first fixing portion segment, and the width of the first elastically moveable portion segment plus the width of the second fixing portion segment is equal to the width of the second elastically moveable portion segment plus the width of the first fixing portion segment.

31. The structure according to claim 28, wherein when the one row of terminals is developed into the plane, the shape of the fixing portion of one of the terminals is reverse-backside joined to the gap region between the elastically moveable portions of the two neighboring terminals to seamlessly rest against the elastically moveable portions of the two neighboring terminals.

32. The structure according to claim 27, wherein the oppositely torn and cut portions of the at least one row of terminals are elastically moveable portions, the width of the fixing portion is greater than the width of the elastically moveable portion, the elastically moveable portion has first and second ends, the first end of the elastically moveable portion is a tail end of the terminal, and the second end of the elastically moveable portion is connected to the fixing portion, wherein gaps between the elastically moveable portions sequentially from the first ends to the second ends of the two neighboring terminals are equal to widths of the elastically moveable portion sequentially from the second end to the first end of the elastically moveable portion, and when the one row of terminals is developed into the plane, a shape of the elastically moveable portion of one of the terminals can be reverse-backside joined to a gap region between the elastically moveable portions of the two neighboring terminals.

33. The structure according to claim 32, wherein when the one row of terminals is developed into the plane, the shape of the elastically moveable portion of one of the terminals is reverse-backside seamlessly jointed to the gap region between the elastically moveable portions of the two neighboring terminals.

34. The structure according to claim 27, wherein when the one row of terminals is developed into the plane and one of the terminals is reverse-backside joined between the two neighboring terminals, a cut surface of the oppositely torn and cut portion of one of the terminals is seamlessly jointed to cut surfaces of the oppositely torn and cut portions of the two neighboring terminals.

35. The structure according to claim 27, wherein the oppositely torn and cut portions of the one row of terminals comprise the pin portions and the fixing portions, a gap between the pin portions of the neighboring terminals is equal to a width of the fixing portion, and a shape of the fixing portion of one of the terminal may be reverse-backside joined to a gap region between the pin portions of the two neighboring terminals.

36. The structure according to claim 35, wherein the shape of the fixing portion of one of the terminals of the one row of terminals may be reverse-backside seamlessly jointed between the gap region between the pin portions of the two neighboring terminals.

37. The structure according to claim 27, wherein the two rows of terminals formed by oppositely tearing and pressing the metal sheet have the same structure.

38. The structure according to claim 27, wherein the oppositely torn and cut portions of the one row of terminals comprise the fixing portions, the fixing portion has a first end connected to the elastically moveable portion and a second end connected to the pin portion, gaps between the fixing portions of the two neighboring terminals of the one row of terminals sequentially from the first ends to the second ends of the fixing portion are equal to widths of the fixing portion of one of the terminals sequentially from the second end to the first end of the fixing portion, and when the one row of terminals is developed into the plane and one of the terminals is reverse-backside joined between the two neighboring terminals, the fixing portion of the terminal is seamlessly jointed to the fixing portions of the two neighboring terminals.

39. The structure according to claim 27, wherein each of two sides of the pin portion is seamlessly jointed to a connection sheet, which has one end connected to the material tape and the other end connected to one end of the fixing portion, the oppositely torn and cut portions of the one row of terminals comprise the elastically moveable portions, the fixing portions and the connection sheets on two sides of the pin portion, and when the one row of terminals is developed into the plane and one of the terminals is reverse-backside joined between the two neighboring terminals, the elastically moveable portion and the fixing portion of the terminal are seamlessly jointed to the connection sheets on the two sides of the pin portions of the two neighboring terminals.

40. A structure of two rows of terminals formed by oppositely tearing and pressing a metal sheet, the structure comprising:

a first row of terminals having a first material tape and multiple separated arranged terminals connected to the first material tape, wherein each of the terminals has an elastically moveable portion, a fixing portion and a pin portion from one end to the other end, a width of the fixing portion is greater than a width of the elastically moveable portion, the elastically moveable portion has a connection point and can elastically move, and each of the terminals has an oppositely torn and cut portion;

a second row of terminals having a second material tape and multiple separately arranged terminals connected to the second material tape, wherein each of the terminals has an elastically moveable portion, a fixing portion and a pin portion from one end to the other end, a width of the fixing portion is greater than a width of the elastically moveable portion, the elastically moveable portion has a connection point and can elastically move, and each of the terminals has an oppositely torn and cut portion;

wherein the first and second rows of terminals are reverse oppositely connected together, and when the first and second rows of terminals are developed into a plane, the oppositely torn and cut portion of each of the terminals of the first row of terminals is seamlessly jointed to a gap region between the oppositely torn and cut portions of the two neighboring terminals of the second row of terminals.

41. The structure according to claim 40, wherein the oppositely torn and cut portions of the first and second row of terminals comprise the elastically moveable portions and the fixing portions, an extension is disposed between the elastically moveable portion and the fixing portion, the width of the fixing portion is greater than a width of the extension and the width of the elastically moveable portion, the elastically moveable portion has first and second ends, the extension has first and second ends, the fixing portion has first and second ends, the first end of the elastically moveable portion is a tail end of the terminal, the second end of the elastically moveable portion is connected to the first end of the extension, the second end of the extension is connected to the first end of the fixing portion, the second end of the fixing portion is connected to the pin portion, and a shape of the fixing portion of the first row of terminals is joined to a gap region between the elastically moveable portions of the two neighboring terminals of the second row of terminals.

42. The structure according to claim 40, wherein the oppositely torn and cut portions of the first and second rows of terminals comprise the elastically moveable portions, the width of the fixing portion is greater than the width of the elastically moveable portion, the elastically moveable portion has a first end being a tail end of the terminal, and a second end connected to the fixing portion, gaps between the elastically moveable portions of the two neighboring terminals sequentially from the first ends to the second ends of the elastically moveable portions are equal to widths of the elastically moveable portion sequentially from the second end to the first end of the elastically moveable portion, and the elastically moveable portion of each of the terminals of the first row of terminals is joined to a gap region between the elastically moveable portions of the two neighboring terminals of the second row of terminals.

43. The structure according to claim 40, wherein the oppositely torn and cut portions of the first and second rows of terminals comprise the fixing portions and the pin portions, a gap between the pin portions of the two neighboring terminals is equal to the width of the fixing portion, the fixing portion of each of the terminals of the first row of terminals is joined to a gap region between the pin portions of the two neighboring terminals of the second row of terminals, and the pin portion of each of the terminals of the first row of terminals is joined to a gap region between the fixing portions of the two neighboring terminals of the second row of terminals.

44. The structure according to claim 40, wherein the oppositely torn and cut portions of the first and second rows of terminals comprise the fixing portions, the fixing portion has a first end connected to the elastically moveable portion, and a second end connected to the pin portion, gaps between the fixing portions of the two neighboring terminals of the first and second rows of terminals sequentially from the first ends to the second ends of the fixing portions are equal to widths of the fixing portion of one of the terminals sequentially from the second end to the first end of the fixing portion, and the fixing portion of each of the terminals of the first row of terminals is joined to a gap region between the fixing portions of the two neighboring terminals of the second row of terminals.

* * * * *